US007661206B2

(12) United States Patent
Osborn

(10) Patent No.: US 7,661,206 B2
(45) Date of Patent: Feb. 16, 2010

(54) METHOD AND APPARATUS FOR FASHION ADAPTABLE FOOTWEAR

(75) Inventor: Holly H. Osborn, 8331 Coeur d'Alene Dr., Fort Collins, CO (US) 80525

(73) Assignee: Holly H. Osborn, Fort Collins, CO (US)

( * ) Notice: Subject to any disclaimer, the term of this patent is extended or adjusted under 35 U.S.C. 154(b) by 613 days.

(21) Appl. No.: 11/461,402

(22) Filed: Jul. 31, 2006

(65) Prior Publication Data

US 2007/0261267 A1 Nov. 15, 2007

Related U.S. Application Data

(63) Continuation-in-part of application No. 29/521,838, filed on Jan. 13, 2006.

(60) Provisional application No. 60/800,297, filed on May 10, 2006.

(51) Int. Cl.
*A43B 3/24* (2006.01)
*A43B 3/12* (2006.01)

(52) U.S. Cl. ..... 36/101; 36/11.5

(58) Field of Classification Search ..... 36/101, 36/100, 15, 11.5

See application file for complete search history.

(56) References Cited

U.S. PATENT DOCUMENTS

| | | | | | |
|---|---|---|---|---|---|
| 3,032,896 | A | * | 5/1962 | Weaver | 36/101 |
| 3,925,915 | A | * | 12/1975 | Colli | 36/11.5 |
| 3,952,429 | A | | 4/1976 | Thomas | 36/31 |
| 3,955,293 | A | | 5/1976 | Benedict | 36/100 |
| 3,978,596 | A | | 9/1976 | Brown et al. | 36/11.5 |
| 3,983,642 | A | | 10/1976 | Liao | 36/101 |
| 3,994,080 | A | | 11/1976 | Flanagan, Jr. et al. | 36/100 |
| 4,172,330 | A | | 10/1979 | Kao | 36/101 |
| 4,193,214 | A | | 3/1980 | Wang | 36/11.5 |
| 4,297,798 | A | | 11/1981 | Colan | 36/101 |
| 4,300,294 | A | | 11/1981 | Riecken | 36/97 |
| 4,302,861 | A | * | 12/1981 | Coppock | 12/142 S |
| 4,429,475 | A | | 2/1984 | Bensley | 36/45 |
| 4,439,935 | A | | 4/1984 | Kelly | 36/101 |
| 4,450,633 | A | | 5/1984 | Connelly | 36/101 |
| 4,461,102 | A | | 7/1984 | DeVincentis | 36/101 |
| 4,713,895 | A | | 12/1987 | Vallieres | 36/1.5 |
| 4,745,693 | A | | 5/1988 | Brown | 36/101 |
| 4,854,056 | A | | 8/1989 | Levin | 36/58.5 |
| 4,869,000 | A | | 9/1989 | York, Jr. | 36/11.5 |
| 4,887,369 | A | | 12/1989 | Bailey et al. | 36/101 |
| 5,065,531 | A | | 11/1991 | Prestridge | 36/100 |

(Continued)

OTHER PUBLICATIONS

Stimpert, Desiree, "Platform Shoes—Platforms—What Makes a Shoe a Platform Shoe?", About, Inc, 2006, 1 page.

(Continued)

*Primary Examiner*—Ted Kavanaugh

(57) ABSTRACT

A platform shoe with detachable upper including a lower shoe member and an upper shoe member is disclosed. The shoe contains snaps or other connector components that provide a detachable attachment between the upper shoe member and the lower shoe member. Embodiments of the present invention include a lower shoe member having features that prevent damage to covering materials that may be caused by sharp edges of the connector components. In addition, the upper shoe member may be stretchable to allow attachment to a variety of lower shoe members of different shapes.

19 Claims, 37 Drawing Sheets

U.S. PATENT DOCUMENTS

| | | | | |
|---|---|---|---|---|
| 5,337,491 | A | 8/1994 | Mascotte | 36/7.1 R |
| 5,339,543 | A | 8/1994 | Lin | 16/2.2 |
| 5,410,821 | A | 5/1995 | Hilgendorf | 36/100 |
| 5,423,134 | A | 6/1995 | Bagnaia et al. | 36/11.5 |
| 5,477,625 | A | 12/1995 | Goldsmith et al. | 36/36 R |
| 5,778,564 | A | 7/1998 | Kettner | 36/101 |
| 5,836,090 | A | 11/1998 | Smith | 36/7.6 |
| 5,852,885 | A | 12/1998 | Ferniani | 36/11.5 |
| 5,896,684 | A | 4/1999 | Lin | 36/101 |
| 5,992,058 | A | 11/1999 | Jneid | 36/100 |
| 6,212,797 | B1 | 4/2001 | Merry et al. | 36/101 |
| 6,349,486 | B1 | 2/2002 | Lin | 36/101 |
| 6,418,643 | B1 | 7/2002 | Yang | 36/101 |
| 6,430,845 | B1 | 8/2002 | Noda | 36/100 |
| 6,449,878 | B1 | 9/2002 | Lyden | 36/27 |
| D467,407 | S | 12/2002 | Berg et al. | D2/916 |
| D467,709 | S | 12/2002 | Berg et al. | D2/947 |
| D470,304 | S | 2/2003 | Berg et al. | D2/978 |
| 6,581,255 | B2 | 6/2003 | Kay | 24/640 |
| 6,601,042 | B1 | 7/2003 | Lyden | 705/26 |
| 6,640,464 | B2 | 11/2003 | Hsin et al. | 36/11.5 |
| 6,651,359 | B1 | 11/2003 | Bricker | 36/101 |
| 6,745,498 | B2 * | 6/2004 | LaDuca | 36/8.3 |
| 6,772,539 | B1 | 8/2004 | Tai | 36/11.5 |
| 6,792,696 | B2 | 9/2004 | Berg et al. | 35/11.5 |
| 6,848,199 | B1 | 2/2005 | Giannelli | 36/11.5 |
| 6,883,252 | B2 | 4/2005 | Cagner | 36/11.5 |
| 6,904,706 | B2 | 6/2005 | Jones et al. | 36/11.5 |
| 6,928,754 | B2 | 8/2005 | Cambronero | 36/11.5 |
| 6,931,766 | B2 | 8/2005 | Greene | 36/101 |
| 2002/0078600 | A1 | 6/2002 | Berg et al. | 36/101 |
| 2002/0194750 | A1 | 12/2002 | Feick | 36/101 |
| 2003/0192205 | A1 | 10/2003 | Linens | 36/100 |
| 2005/0016019 | A1 | 1/2005 | Smith et al. | 36/11.5 |
| 2005/0034332 | A1 | 2/2005 | Moschel et al. | 36/101 |
| 2005/0126045 | A1 | 6/2005 | Guidry | 36/101 |

OTHER PUBLICATIONS

Kippen, Cameron, "The History of Shoes: Shoe Making", Curtin Health Science, Department of Podiatry, Dec. 2004, 29 pages.

* cited by examiner

METHOD AND APPARATUS FOR FASHION ADAPTABLE FOOTWEAR

CROSS REFERENCE TO RELATED APPLICATIONS

This application is a continuation-in-part of U.S. Design Pat. Application No. 29/521838 filed on Jan. 13, 2006, also claims the benefit of U.S. Provisional Patent Application No. 60/800,297, filed May 10, 2006, both applications being incorporated herein in their entirety.

FIELD OF THE INVENTION

The present invention is directed to footwear and more specifically, some embodiments may include interchangeable uppers for platform shoes and the like.

BACKGROUND OF THE INVENTION

Shoes are typically constructed with a sole (bottom portion), mid-sole (internal part that connects between the foot and the sole) and an upper (part that covers the top of the foot). An upper may also be called a cover. The mid-sole often contains a shank (metal reinforcement for the arch of the shoe), fiberboard and/or thin stiffening agent made of pressed paper or cardboard and a light, medium or heavy padding. The mid-sole typically runs the entire length of the shoe and may be a standard product for all shoe constructions. When a shoe is made, an upper is typically attached to the mid-sole with nails, glue or other adhesive. Attaching the bottom sole of the shoe is generally the last part of the shoe construction process. Platform shoes, on the other hand, are typically made with a separate platform base of various different widths, lengths, sizes and the like.

Various footwear systems have been disclosed in the past, such as a detachable shoe strap system in U.S. Pat. No. 5,992,058 to Jneid where straps are detachably couplable to a side wall of a sole member. This system, however does not address the interchangeability of straps between different sole members. U.S. Pat. No. 4,461,102 to DeVincentis discloses interchangeable shoe strap systems having spring connectors. However, this system does not include use with platform shoes and does not include flexible uppers, among other aspects. In addition, an article of footwear is disclosed in U.S. Pat. No. 4,300,294 to Riecken where straps are anchored to a platform to secure a platform to a wearer's foot. Here, the straps are not interchangeable so as to enable a user to change the upper portion of a shoe. None of the above-noted prior art uses interchangeable uppers or flexible interchangeable uppers in conjunction with platform shoes. Accordingly, it would advantageous to provide a platform base that offers a sturdier and more durable shoe system for interchangeable uppers, including flexible uppers.

SUMMARY OF THE INVENTION

The shortcomings of the prior art are addressed by embodiments of the present invention that include a footwear system comprising connector elements, such as snaps, hook and loop and the like to removably fasten different color or styles of uppers. Embodiments of the present invention may include a base made from a plastic, rubber, microfiber, wood, or the like where the connector elements may be directly mounted. A unique construction is used that is specific to platform shoes (and 'wedges') and is not applicable to all shoes. Leather, fabric, or other material uppers may are detachably attachable to a platform base such as a sole with snaps or the like as discussed herein. One advantage of the present invention is that several different uppers can be made in various colors and styles and they may all be interchangeable with various different platform bases, heel heights, and the like.

When a standard shoe is made, there may be one upper made for each shoe. In the present invention, multiple uppers may be made independently of the making of any lower or platform base unit. Thus the present invention facilitates a change from the one-to-one ratio of how many uppers and base units can be constructed. Accordingly it is an aspect of the present invention to provide a shoe having a platform base that can be fitted with a detachably attachable upper. It is further aspect to provide an upper that may be interchangeably used with platform bases having different heel heights.

Thus in accordance with embodiments of the present, a shoe system is provided comprising: a lower shoe member comprising a platform having a thickness; a plurality of snaps having male and female components, the male components having a diameter not greater than the thickness of the platform, wherein the male components are interconnected to the platform, the male components comprising a burnished circumferential edge; a barrier interconnected to the platform and covering at least a portion of the circumferential edge of the male components, the barrier comprising a plurality of holes, wherein a portion of the male component extends through the hole laterally beyond the barrier; a leather outer portion covering: the platform; at least a portion of the male components of the plurality of snaps; and the barrier; the leather outer portion comprising a plurality of holes substantially aligned with the plurality of holes in the barrier, wherein a portion of the male component extends through the hole laterally beyond the leather outer portion; an upper shoe member comprising at least one of the female components of the plurality of snaps, wherein the male and female snap components cooperate to provide a detachable attachment between the lower shoe member and the upper shoe member, the upper shoe member comprising a plurality of regions, wherein at least one region of the plurality of regions comprises stretchable material, and wherein at least one region of the plurality of regions comprises a substantially non-stretchable material. In accordance with embodiments of the present invention, the shoe system, further comprises: a second lower shoe member comprising: a second platform having a thickness; a second plurality of male snap components having a diameter not greater than the thickness of the second platform, wherein the second plurality of male snap components are interconnected to the second platform, the second plurality of male snap components comprising burnished circumferential edges; a second barrier interconnected to the second platform and covering at least a portion of the circumferential edge of the second male snap components, the second barrier comprising a plurality of holes, wherein a portion of the male component extends through the hole laterally beyond the second barrier; and a second leather outer portion covering: the second platform; at least a portion of the male components of the second plurality of snaps; and the second barrier; the second leather outer portion comprising a plurality of holes substantially aligned with the plurality of holes in the second barrier, wherein a portion of the second male snap components extend through the hole laterally beyond the second leather outer portion; wherein the first plurality of male snap components interconnected to the first lower shoe member are spaced differently than the second plurality male snap components interconnected to the second lower shoe member; and wherein the upper shoe member is connectable to both the first and the second lower shoe members.

It is another aspect of the present invention to provide a shoe system utilizing a protective layer for an upper to lower connection system. Thus, in accordance with embodiments of the present invention, a shoe system is provided, comprising: a first shoe member comprising a platform and a covering material overlying at least a portion of the platform, wherein a plurality of first connector members are interconnected to the platform, and wherein a protective layer is located between at least a portion of the connection member and the covering material; and a second shoe member comprising a plurality of second connector members, wherein the first and second connector members cooperate to provide a detachable attachment between the first shoe member and the second shoe member. In accordance with embodiments of the present invention, the plurality of first connector members comprise male snap components, and the second connector members comprise female snap components. In accordance with embodiments of the present invention the covering material comprises leather. In accordance with embodiments of the present invention the first connector members comprise burnished edges. In accordance with embodiments of the present invention, the second shoe member further comprises a plurality of regions, and wherein at least one region of the plurality of regions comprises stretchable material, and wherein at least one region of the plurality of regions comprises a substantially non-stretchable material. In accordance with embodiments of the present invention, the shoe system, further comprises a third shoe member comprising a platform and a plurality of first connector members interconnected to the platform; wherein the plurality of first connector members interconnected to the first shoe member platform are spaced differently than the plurality of first connector members interconnected to the third shoe member platform; herein the second shoe member is connectable to both the first and the third shoe members.

It is yet still another aspect of the present invention to provide a shoe system utilizing connector members that are burnished to protect against damaging a material covering at least a portion of the shoe. Thus, in accordance with embodiments of the present invention, a shoe system is provided, comprising: a first shoe member comprising a platform and a covering material overlying at least a portion of the platform, wherein a plurality of first connector members are interconnected to the platform, and wherein the first connector members comprise burnished edges; and a second shoe member comprising a plurality of second connector members, wherein the first and second connector members cooperate to provide a detachable attachment between the first shoe member and the second shoe member. Additionally, other features as previously discussed may form part of the present embodiment.

It is yet another aspect of the present invention to provide a shoe system having an upper with a plurality of material types and properties. Thus, in accordance with embodiments of the present invention, a shoe system is provided, comprising: a first shoe member comprising a platform and a plurality of first connector members interconnected to the platform; and a second shoe member comprising a plurality of second connector members, wherein the first and second connector members cooperate to provide a detachable attachment between the first shoe member and the second shoe member, the second shoe member comprising a plurality of regions, and wherein at least one region of the plurality of regions comprises stretchable material, and wherein at least one region of the plurality of regions comprises a substantially non-stretchable material. Additionally, other features as previously discussed may form part of the present embodiment.

It is an aspect of the present invention to provide an upper with a novel structure allowing interchangeability with bases. Thus, in accordance with embodiments of the present invention, an upper shoe member is provided for use with a lower shoe member having a platform and a plurality of first connector members interconnected to the platform, the upper shoe member comprising: a plurality of second connector members; and plurality of regions, wherein at least one region of the plurality of regions comprises stretchable material, and wherein at least one region of the plurality of regions comprises a substantially non-stretchable material; wherein the first and second connector members cooperate to provide a detachable attachment between the upper shoe member and the lower shoe member.

It is a further aspect of the invention to provide a shoe system that allows for a variety of structures to fulfill certain functions. Thus, in accordance with embodiments of the present invention, a shoe system is provided, comprising: means for detachably attaching an upper shoe member to a lower shoe member; means for covering the lower shoe member; and means for preventing the means for detachably attaching from damaging the means for covering. In accordance with embodiments of the present invention, the upper shoe member comprises means for stretching the upper shoe member. In accordance with embodiments of the present invention, the means for detachably attaching is chosen from the group consisting of: snaps, hooks, loops, velcro, tabs, and clips.

It is a further aspect of the present invention to provide a method of making a shoe having a detachable upper. Thus, in accordance with embodiments of the present invention a method is provided for forming a platform shoe with detachable upper comprising the steps of forming a lower shoe member by the steps of: forming a shoe platform; interconnecting a plurality of first connector members to the platform; interconnecting a barrier member to the shoe platform, wherein the barrier member covers at least circumferential portion of the connector members; and covering the platform, the barrier member and at least a portion of the first connector member with a material; and forming an upper shoe member comprising a second plurality of connector members; wherein the first and second connector members cooperate to provide a detachable attachment between the first shoe member and the second shoe member.

BRIEF DESCRIPTION OF THE DRAWINGS

FIG. 9A is a top view of the footwear embodiment shown in FIG. 8A and that includes a narrower, higher heel element with a larger front replaceable cover and a more rounded toe shape and having bottom ornamental connection elements visible.

FIG. 12A is a perspective view of a footwear embodiment including a wider, higher heel element with a larger front replaceable cover and a more rounded toe shape and having bottom ornamental connection elements visible.

FIG. 13A is a top view of the footwear embodiment shown in FIG. 12A and that includes a wider, higher heel element with a larger front replaceable cover and a more rounded toe shape and having bottom ornamental connection elements visible.

FIG. 16A is a perspective view of a footwear embodiment including a wider, lower heel element with a larger front replaceable cover and a more rounded toe shape and having bottom ornamental connection elements visible.

FIG. 18A is a left side view of the footwear embodiment shown in FIG. 16A and that includes a wider, lower heel element with a larger front replaceable cover and a more rounded toe shape and having bottom ornamental connection elements visible.

FIG. 30A is a left side view of the footwear embodiment shown that includes a narrower, higher heel element with a larger front replaceable cover and a more rounded toe shape and having sliver stud designed bottom ornamental connection elements.

DETAILED DESCRIPTION OF THE INVENTION

The present invention includes a variety of aspects that may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1A:
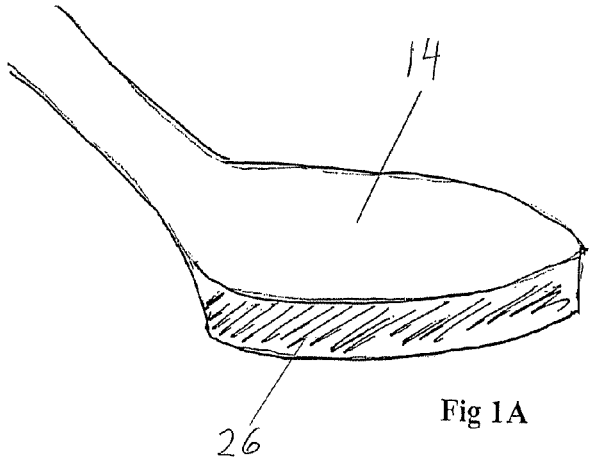
FIG. 1A shows a perspective partial side view of one example of a platform component attached to a ball-of-foot portion of a sole of a shoe in accordance with embodiments of the present invention.
Figure 1B:
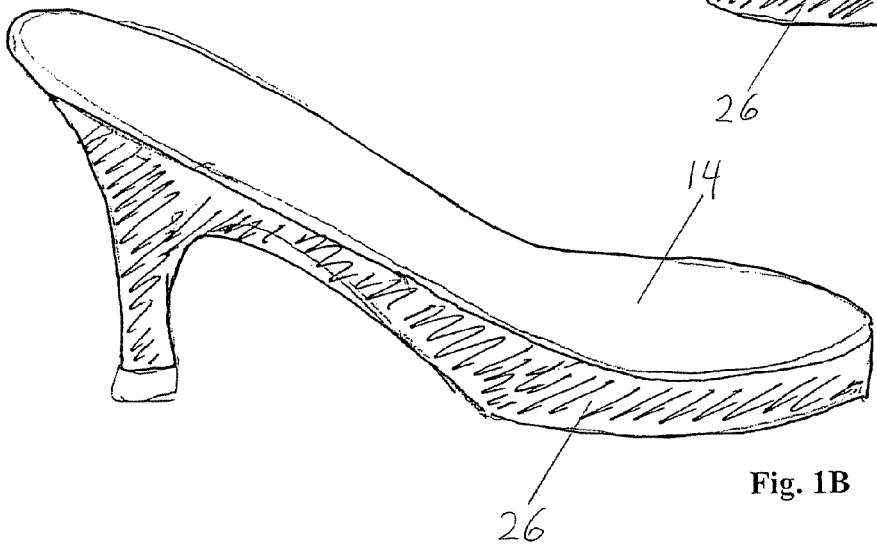
FIG. 1B shows a side perspective view of one example of a whole shoe platform component in accordance with embodiments of the present invention.
Figure 1C:
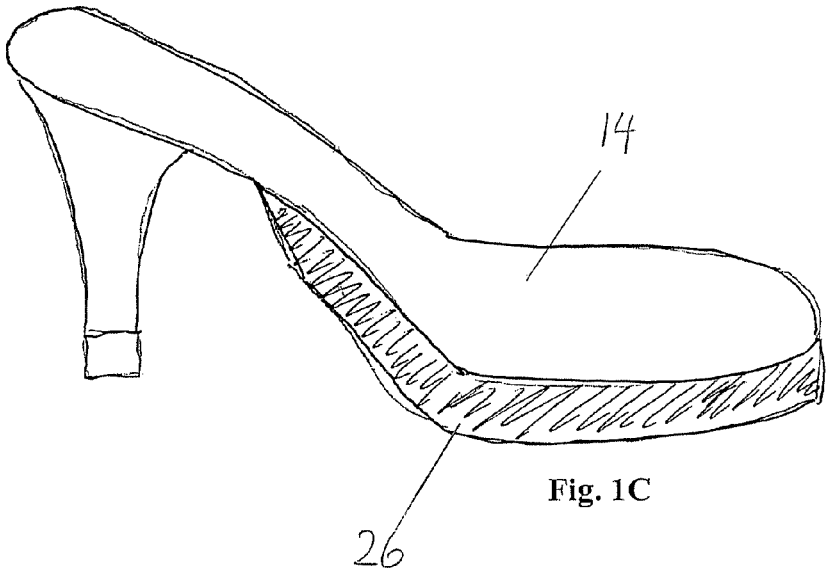
FIG. 1C shows a side perspective view of one example of a platform component attached to a ball of foot portion and extending to a middle of sole in accordance with embodiments of the present invention.

Referring now to FIGS. 1A-1C embodiment of the present invention have application to platform shoes that include a variety of configurations. As will be discussed in more detail below, the shoes may have different shaped bases or platforms. Thus, while some specific designs are shown different platform configurations are encompassed by the scope of the present invention.

Figure 2A:
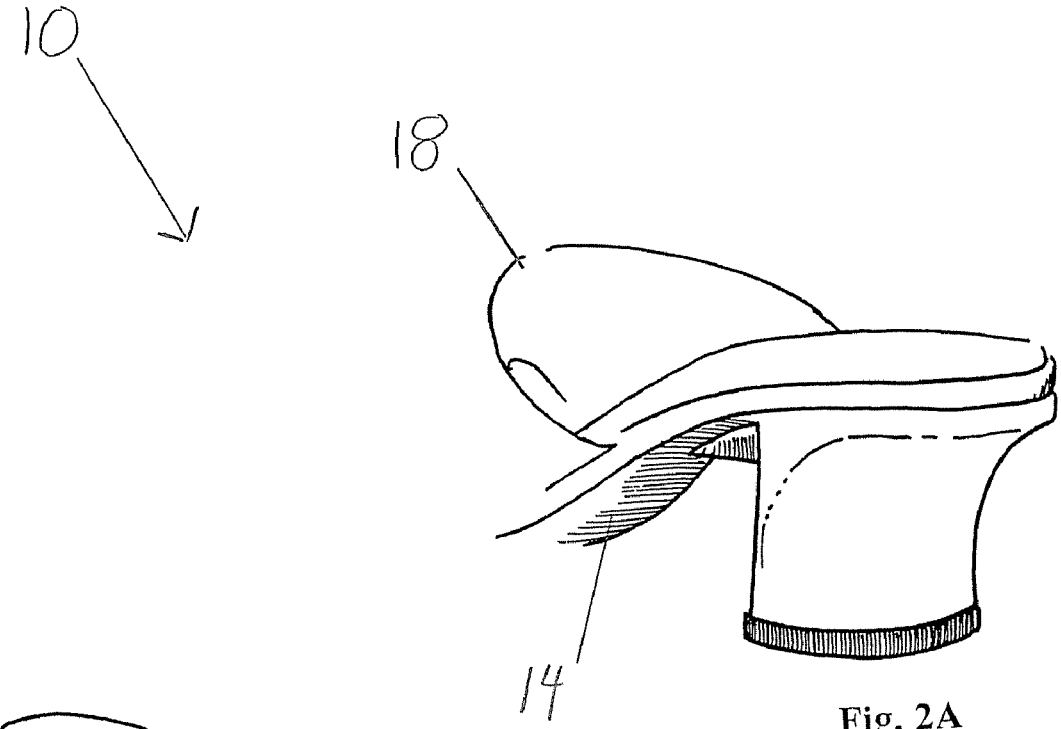
FIG. 2A shows a perspective back side view of one example of an upper on a sandal in accordance with embodiments of the present invention.
Figure 2B:
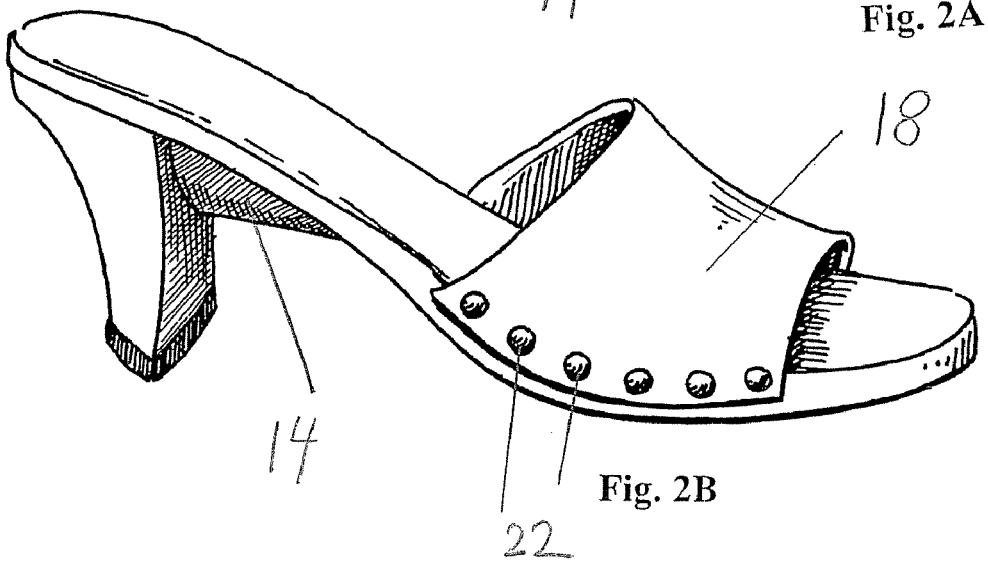
FIG. 2B shows a side perspective view of one example of an upper attached with exposed snaps on a sandal in accordance with embodiments of the present invention.
Figures 3A, 3B:
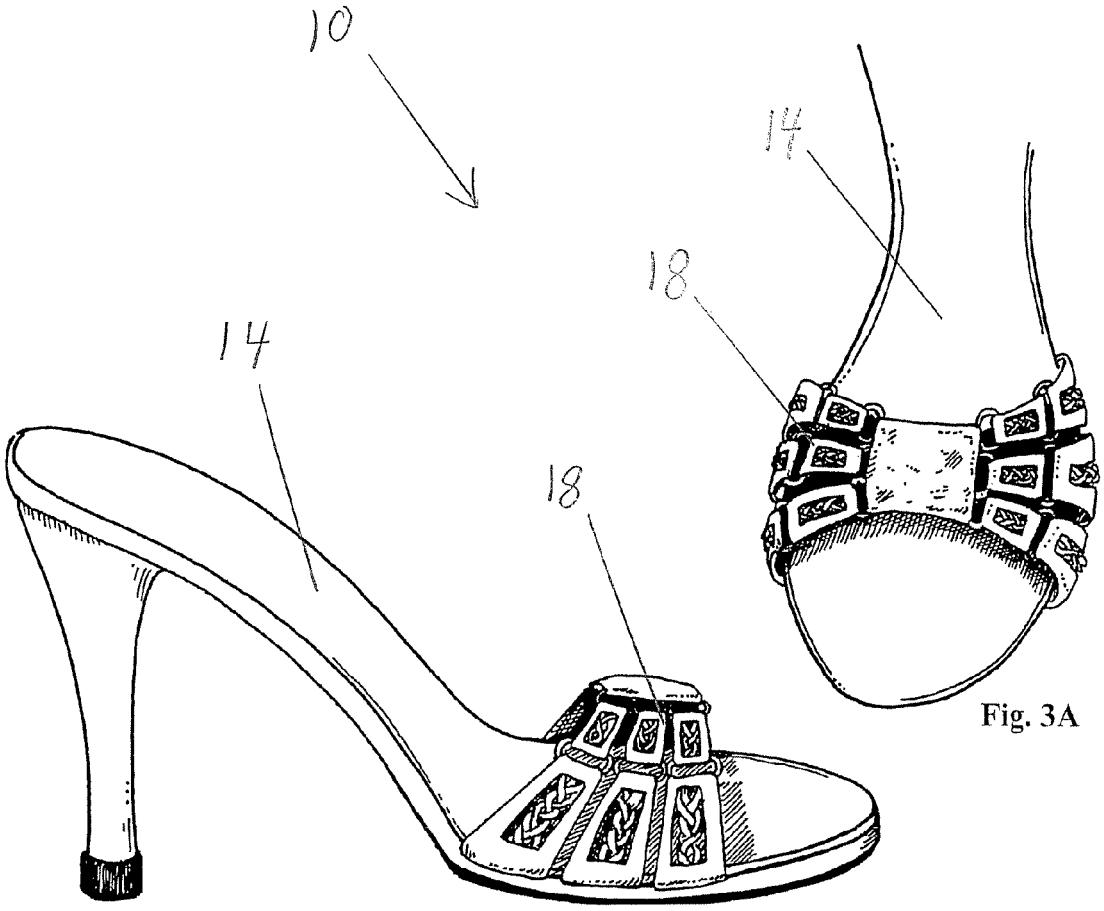
FIG. 3A shows a top view of one example of an upper attached with hidden attachment elements such as snaps in accordance with embodiments of the present invention.
FIG. 3B shows a side perspective view of one example of an upper attached with hidden attachment elements such as snaps in accordance with embodiments of the present invention.

With reference now to FIG. 2B, a platform shoe with a detachable upper 10 in accordance with embodiments of the present invention is illustrated including a lower portion or lower 14 and an upper portion or lower 18. The upper 18 is attached to the lower 14 by means of snaps 22. The upper 18 is capable of being unsnapped and removed from the lower 14. While FIG. 2B shows a platform shoe with detachable upper 10 with visible snaps 22, other embodiments of the present invention include platform shoe 10 with detachable uppers 18 that contain snaps 22 that are not visible when the upper 18 is connected to the lower 14. In such an embodiment, the snaps 22 are hidden, such as by being covered by leather, fabric, appliqué, material, or the like. For example, the platform shoe with detachable upper 10 shown in FIG. 3B includes an upper 18 connected to a lower 14 by means of snaps 22 that are hidden from view.

Figures 4A, 4B:
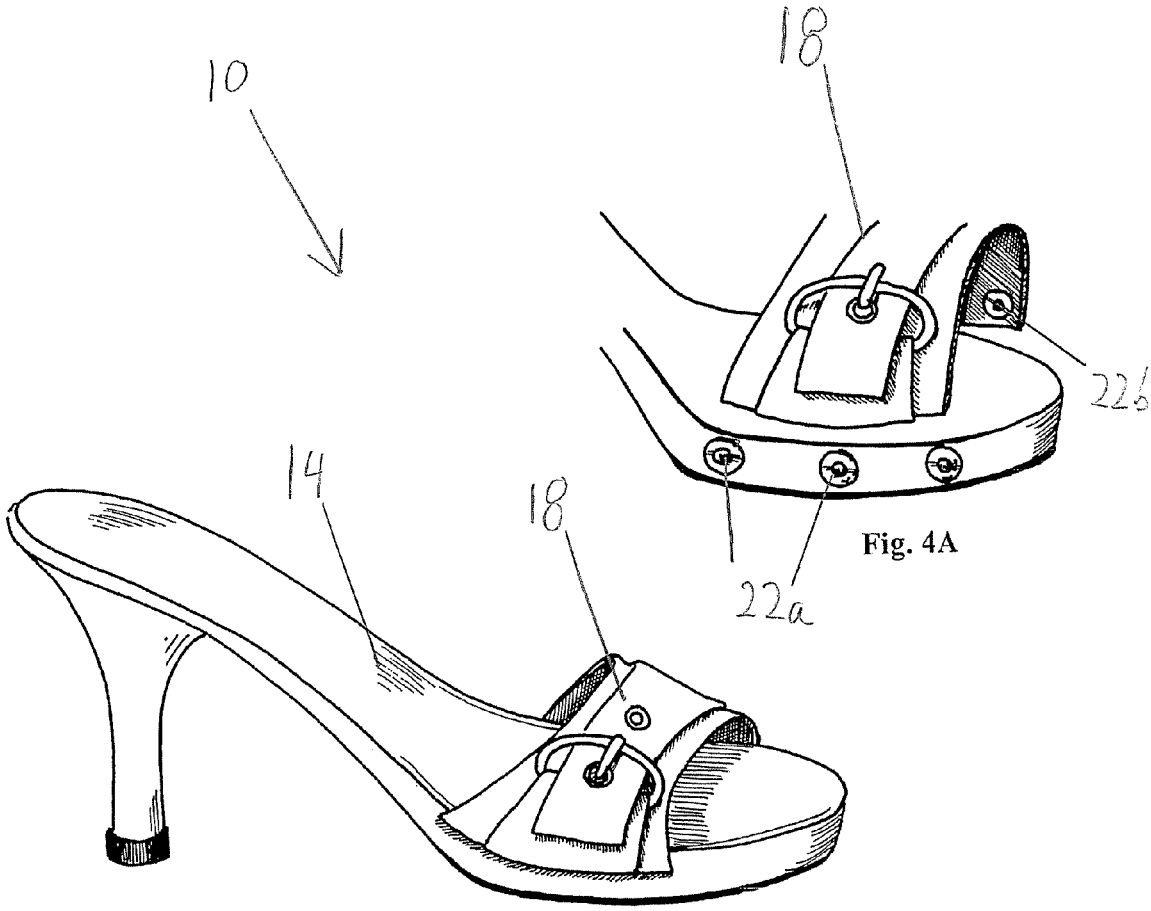
FIG. 4A shows a perspective partial side view of one example of an upper and hidden attachment elements such as snaps in accordance with embodiments of the present invention.
FIG. 4B shows a side perspective view of one example of an upper as attached with hidden attachment elements such as snaps in accordance with embodiments of the present invention.
Figure 5A:
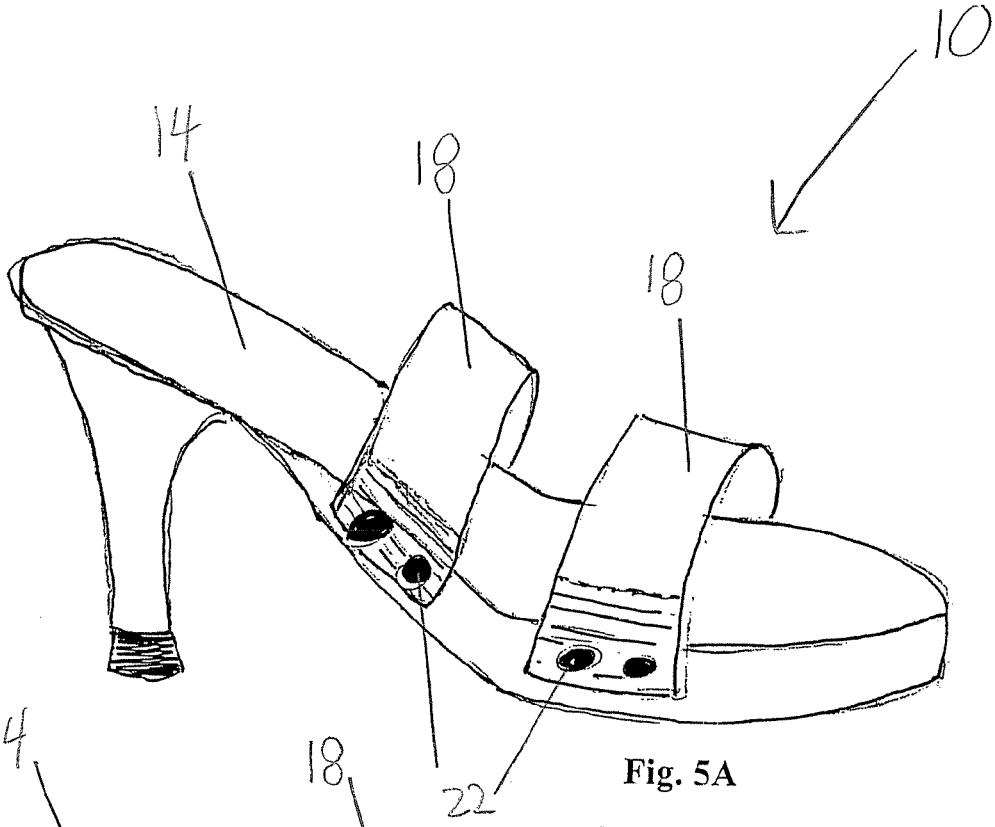
FIG. 5A shows a side perspective view of one example of a flexible upper having an elastic band sewn to a material such as a leather, fabric, or the like in a stretched position as attached with attachment elements to a high heeled base in accordance with embodiments of the present invention.
Figure 5B:
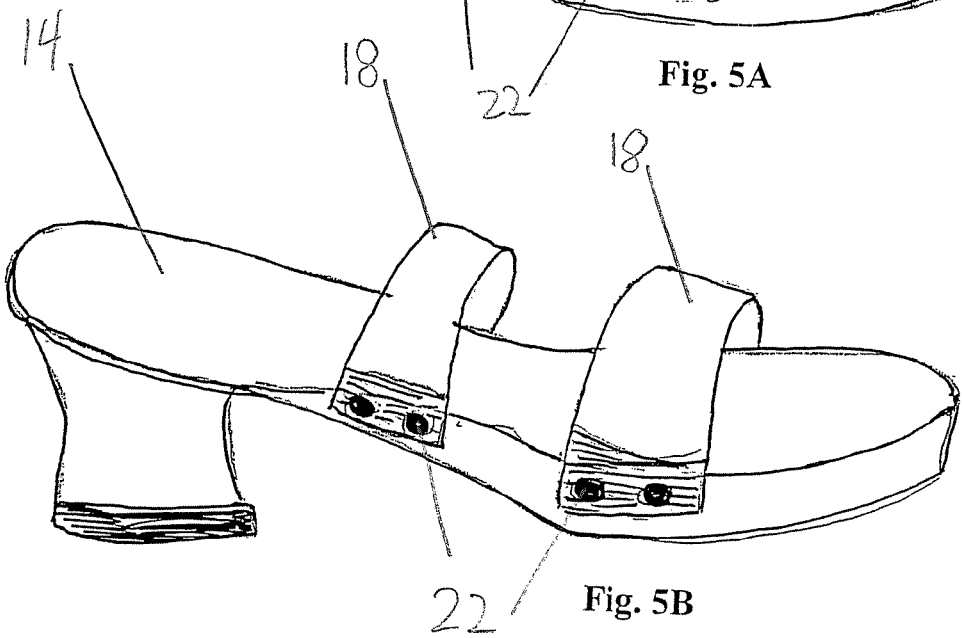
FIG. 5B shows a side perspective view of one example of a flexible upper having an elastic band sewn to a material such as a leather, fabric, or the like in an non-stretched position as attached with attachment elements to a low heeled base in accordance with embodiments of the present invention.
Figure 6A:
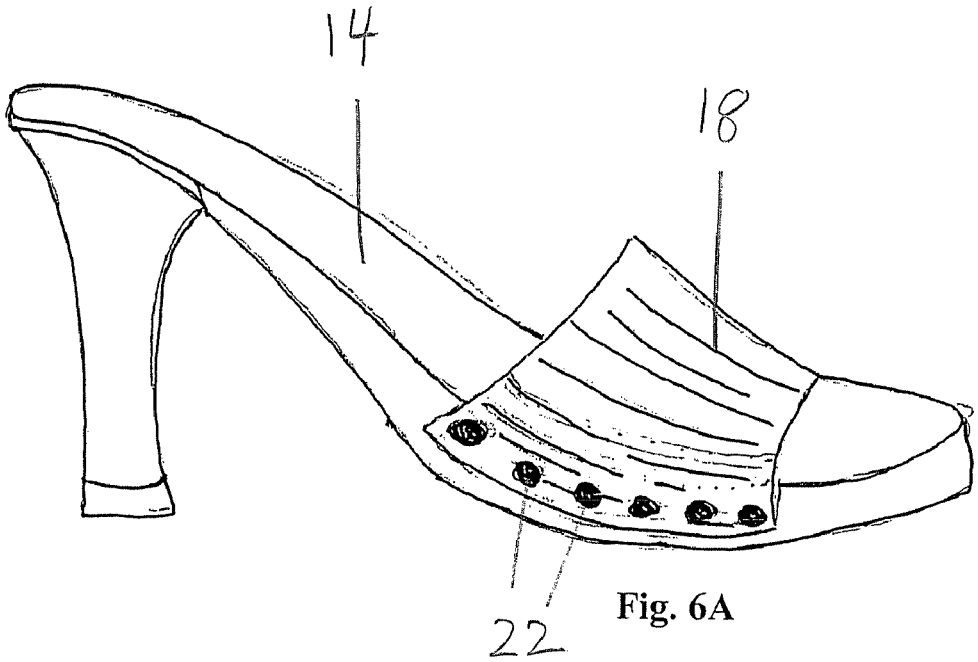
FIG. 6A shows a side perspective view of one example of a flexible upper having elastic material such elastic fabric or the like in a stretched position as attached with attachment elements to a high heeled base in accordance with embodiments of the present invention.
Figure 6B:
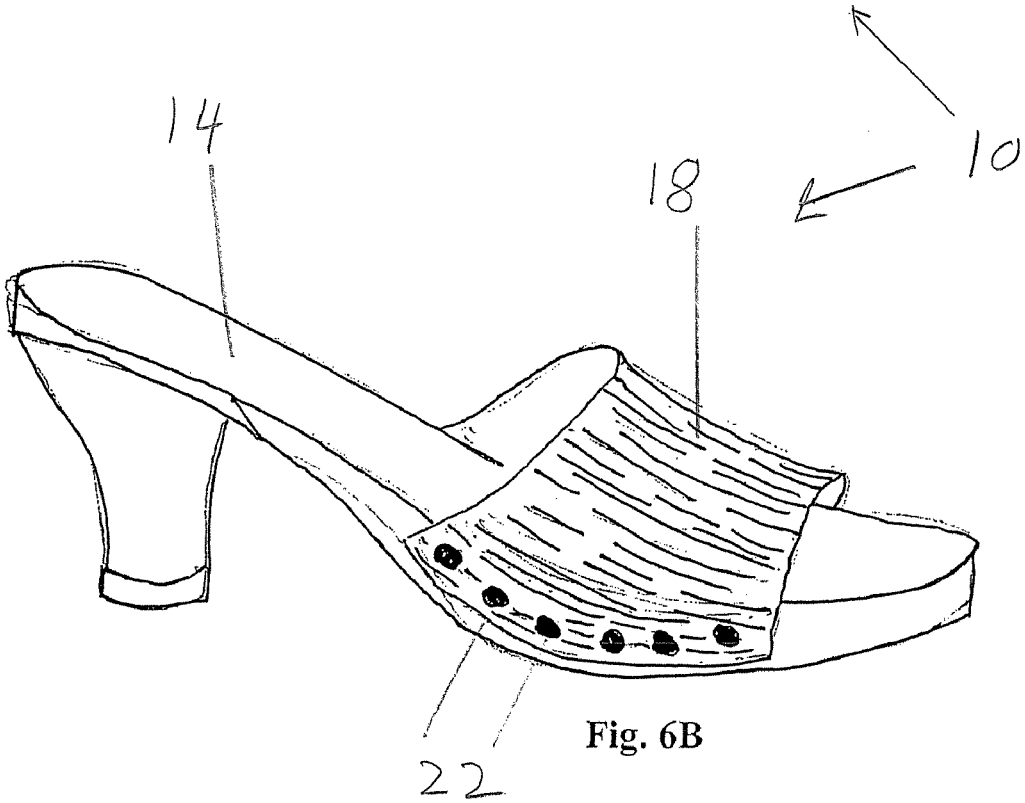
FIG. 6B shows a side perspective view of one example of a flexible upper having elastic material such elastic fabric or the like in a non-stretched position as attached with attachment elements to a low heeled base in accordance with embodiments of the present invention.
Figure 7A:
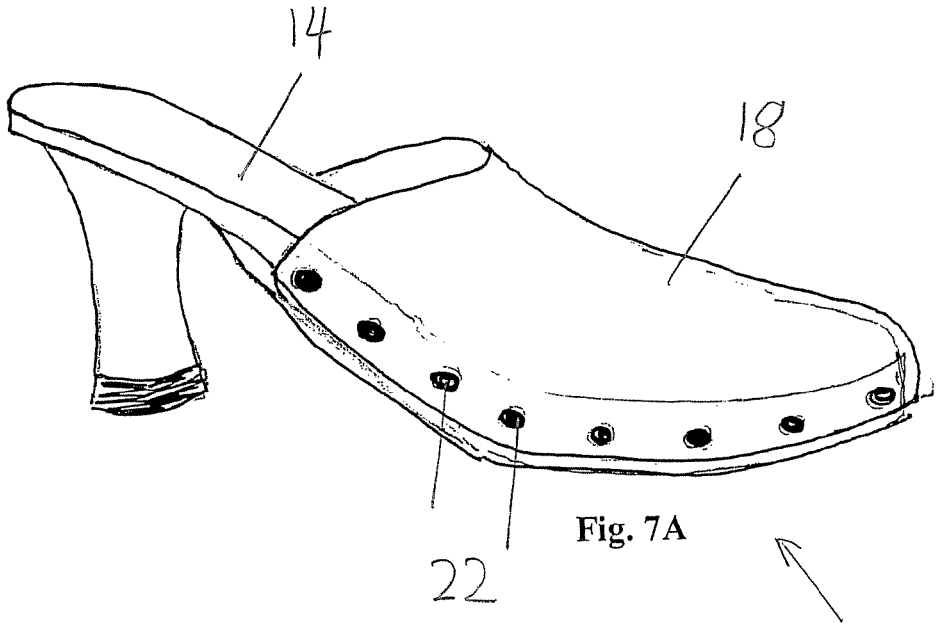
FIG. 7A shows a side perspective view of one example of a slide upper as attached with attachment elements to a base in accordance with embodiments of the present invention.
Figure 7B:
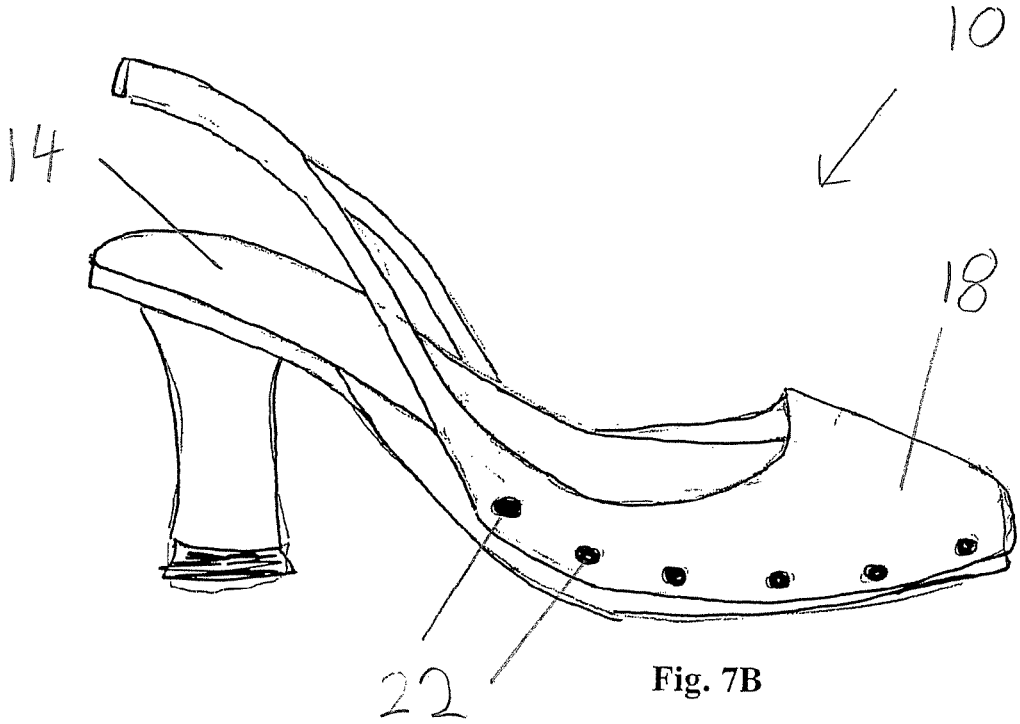
FIG. 7B shows a side perspective view of one example of a slingback upper as attached with attachment elements to a base in accordance with embodiments of the present invention.
Figure 8A:
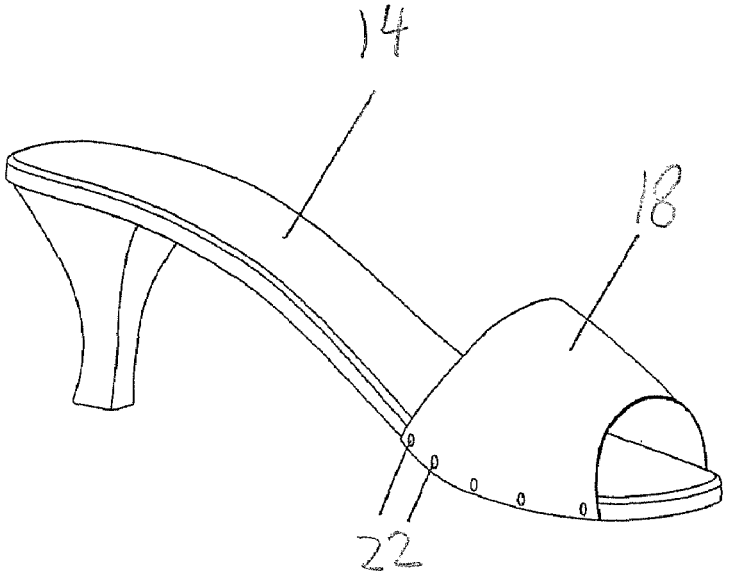
FIG. 8A is a perspective view of a footwear embodiment including a narrower, higher heel element with a larger front replaceable cover and a more rounded toe shape and having bottom ornamental connection elements visible.
Figure 8B:
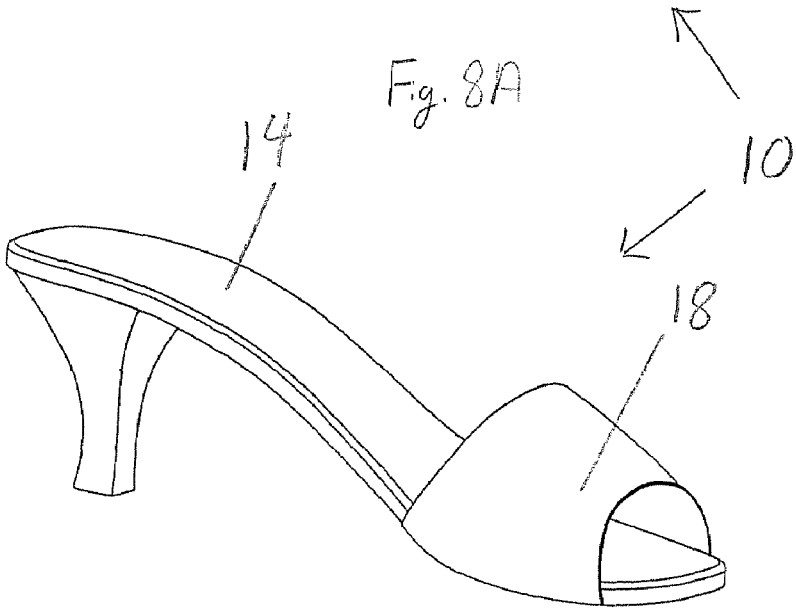
FIG. 8B is a perspective view of another footwear embodiment including a narrower, higher heel element with a larger front replaceable cover and a more rounded toe shape without bottom connection elements being visible.
Figure 9B:
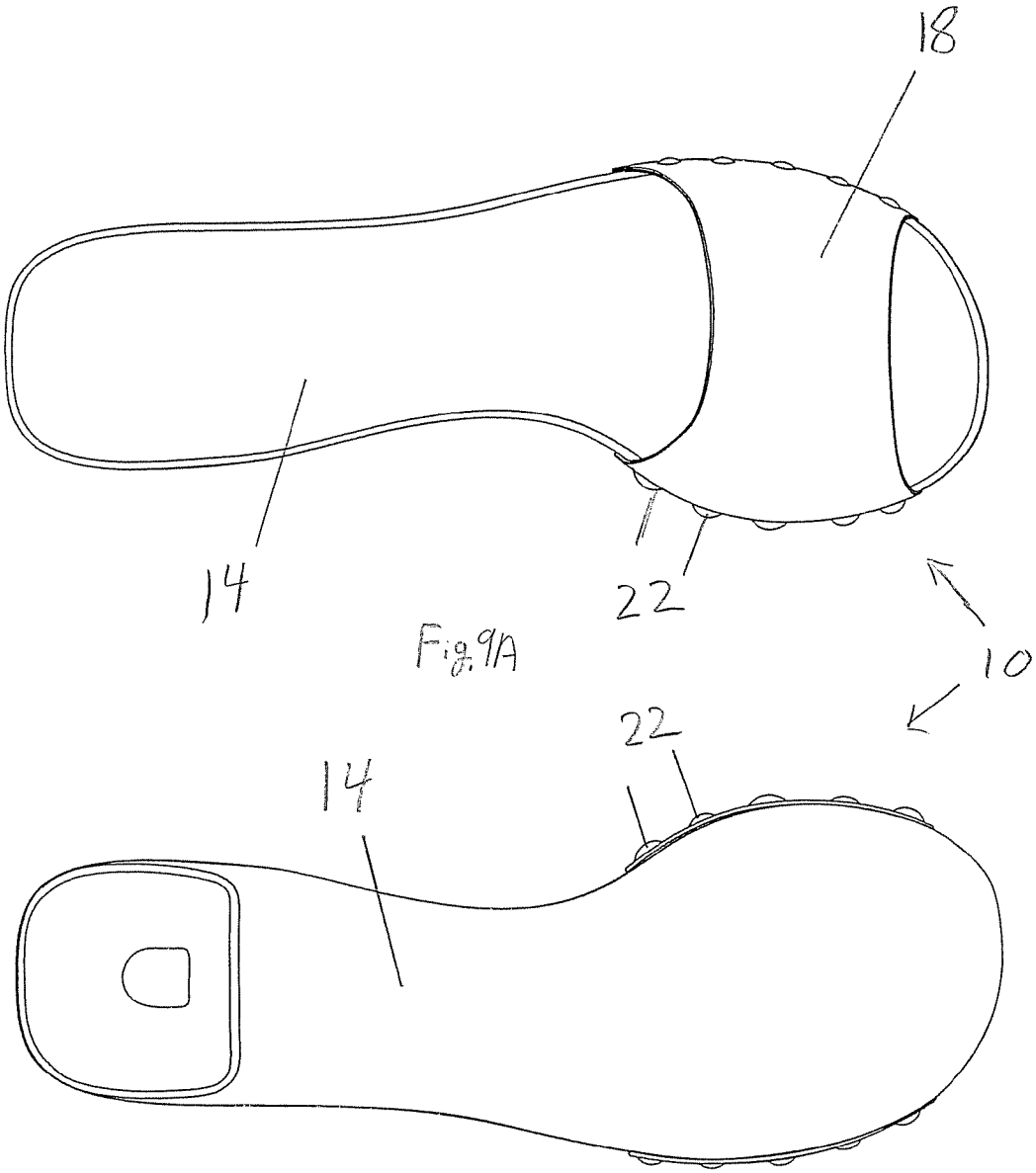
FIG. 9B is a bottom view of the footwear embodiment shown in FIG. 8A and that includes a narrower, higher heel element with a larger front replaceable cover and a more rounded toe shape and having bottom ornamental connection elements visible.
Figure 10A:
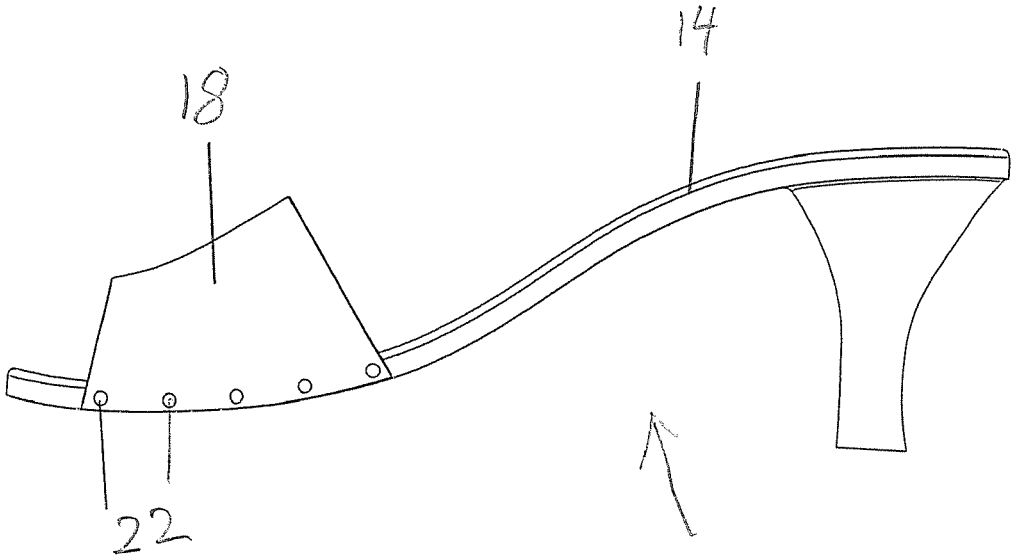
FIG. 10A is a left side view of the footwear embodiment shown in FIG. 8A and that includes a narrower, higher heel element with a larger front replaceable cover and a more rounded toe shape and having bottom ornamental connection elements visible.
Figure 10B:
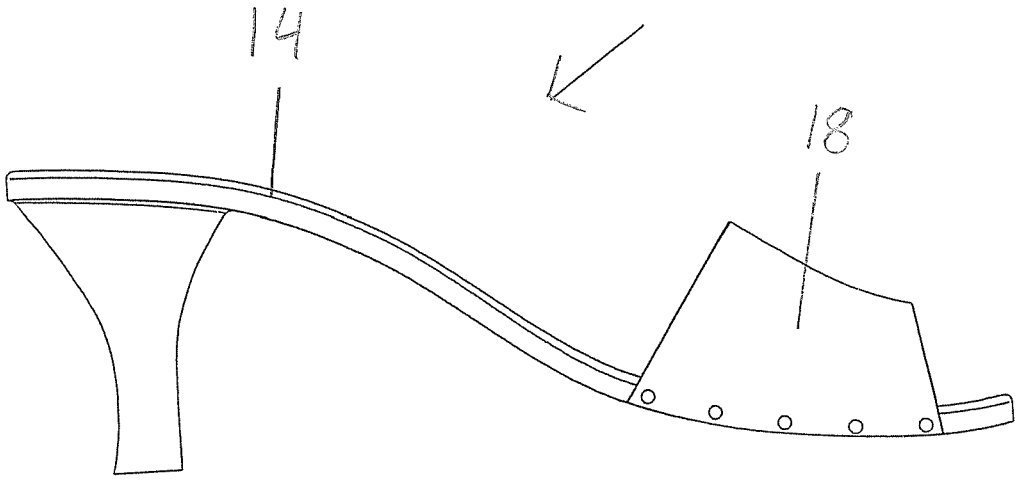
FIG. 10B is a right side view of the same footwear embodiment as shown in FIG. 8A and that includes a narrower, higher heel element with a larger front replaceable cover and a more rounded toe shape and having bottom ornamental connection elements visible.
Figure 11A:
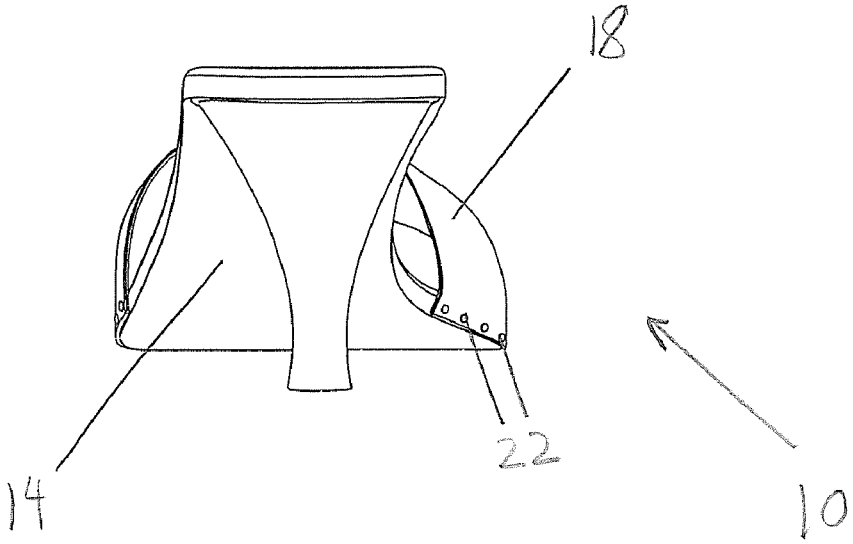
FIG. 11A is a back view of the footwear embodiment shown in FIG. 8A and that includes a narrower, higher heel element with a larger front replaceable cover and a more rounded toe shape and having bottom ornamental connection elements visible.
Figure 11B:
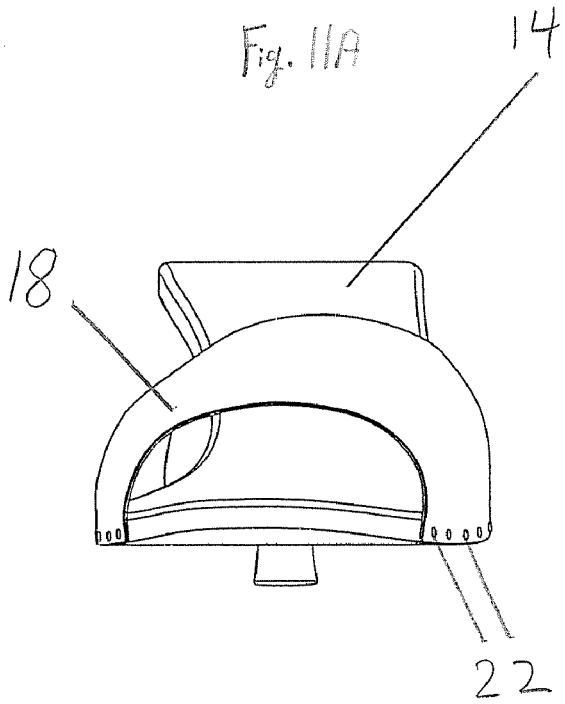
FIG. 11B is a front view of the same footwear embodiment as shown in FIG. 8A and that includes a narrower, higher heel element with a larger front replaceable cover and a more rounded toe shape and having bottom ornamental connection elements visible.
Figure 12B:
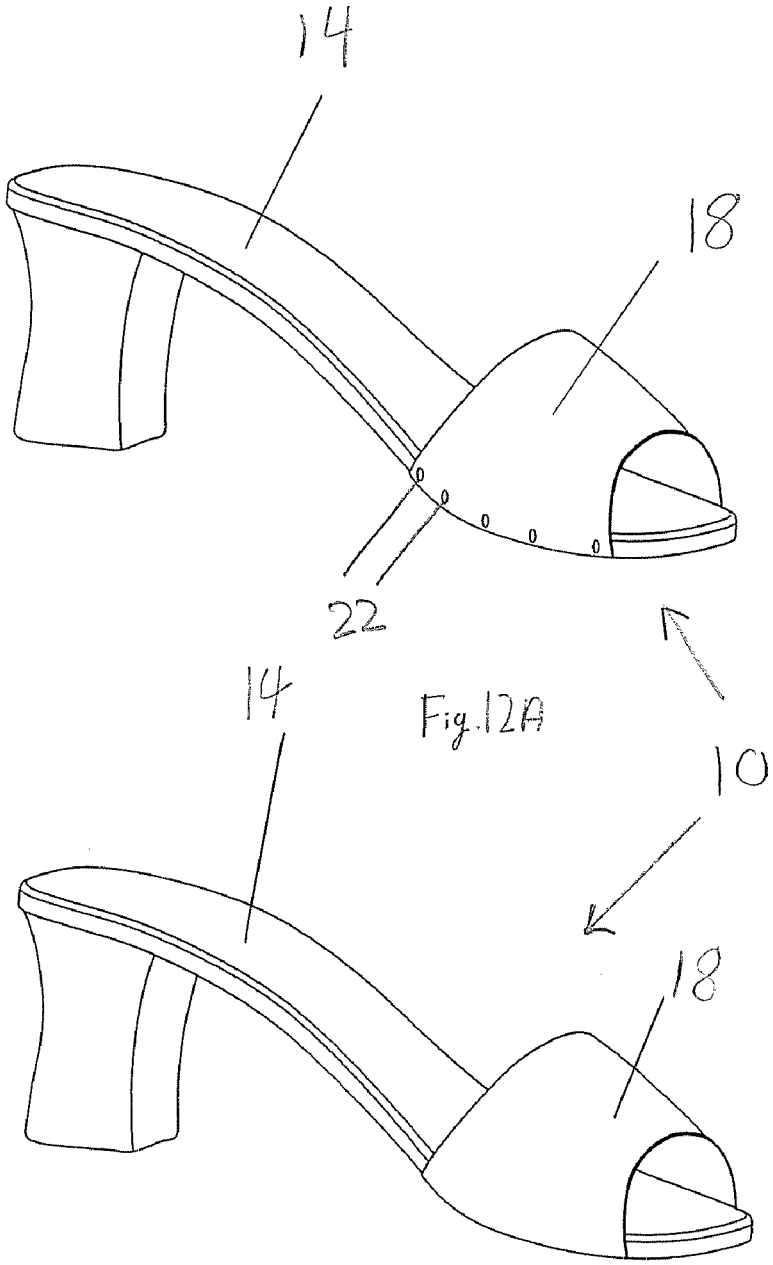
FIG. 12B is a perspective view of another footwear embodiment including a wider, higher heel element with a larger front replaceable cover and a more rounded toe shape without bottom connection elements being visible.
Figure 13B:
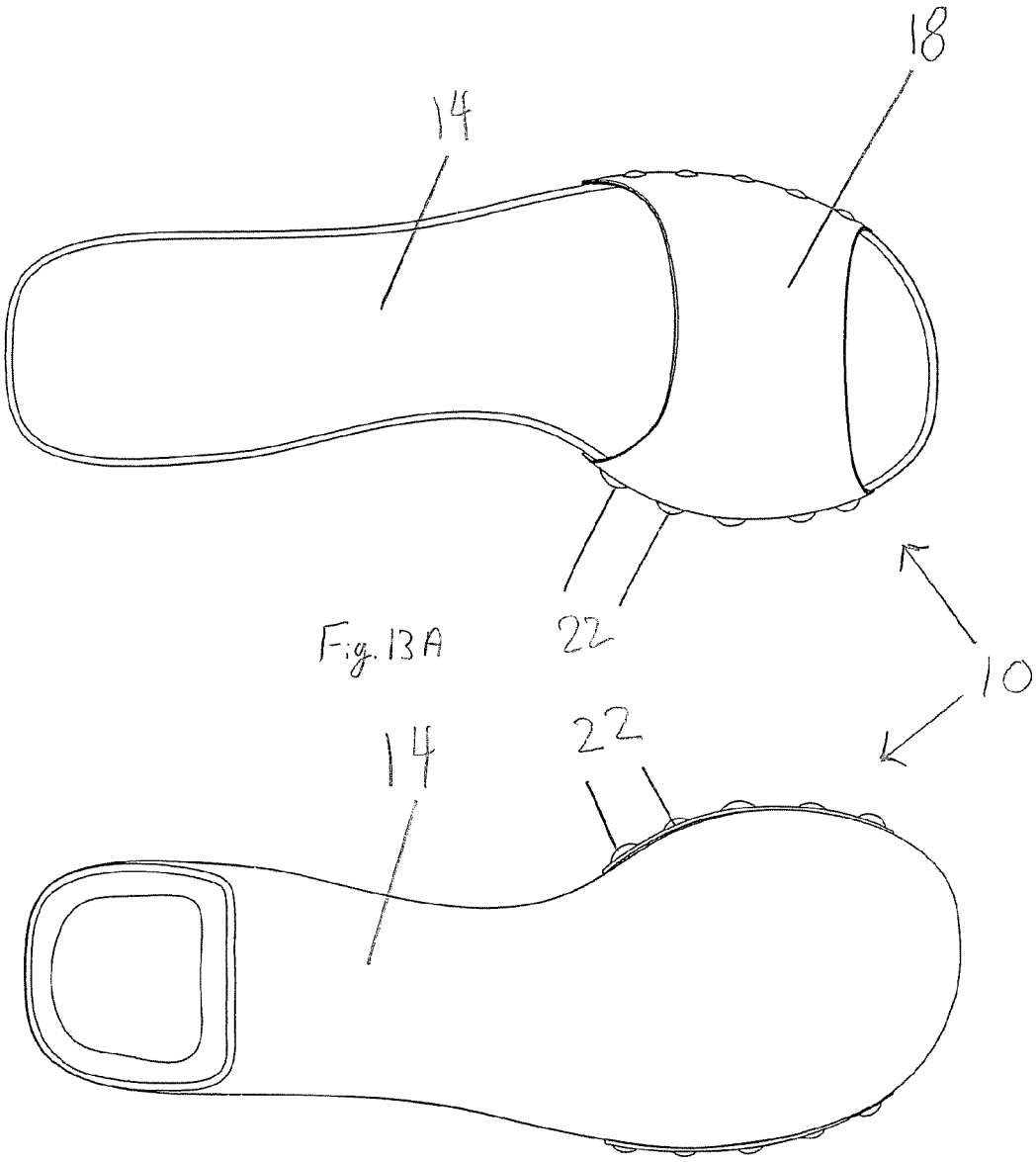
FIG. 13B is a bottom view of the footwear embodiment shown in FIG. 12A and that includes a wider, higher heel element with a larger front replaceable cover and a more rounded toe shape and having bottom ornamental connection elements visible.
Figure 14A:
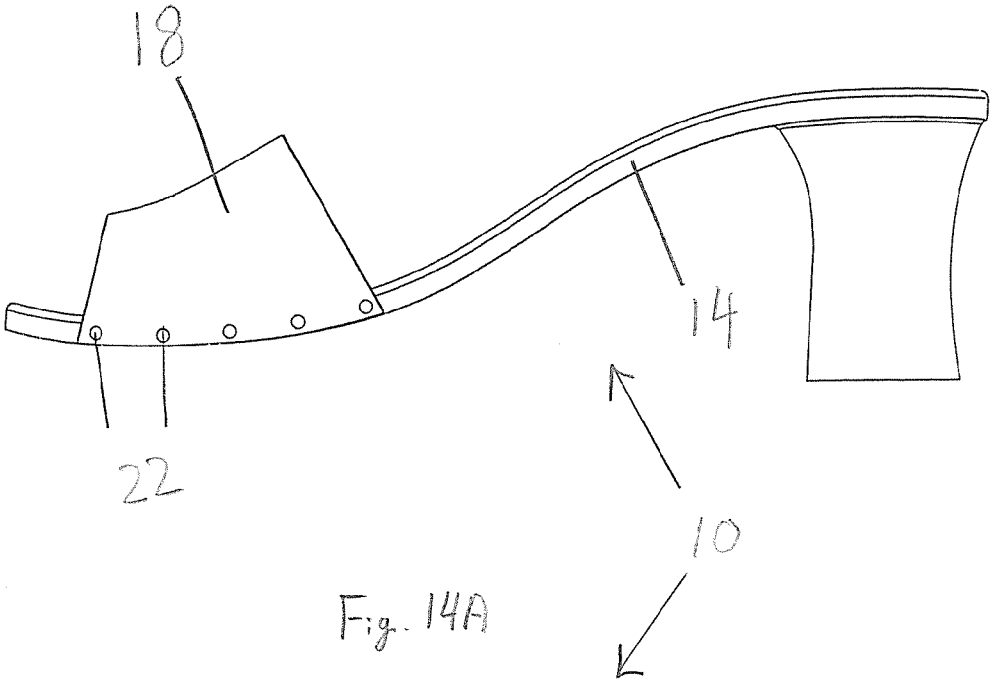
FIG. 14A is a left side view of the footwear embodiment shown in FIG. 12A and that includes a wider, higher heel element with a larger front replaceable cover and a more rounded toe shape and having bottom ornamental connection elements visible.
Figure 14B:
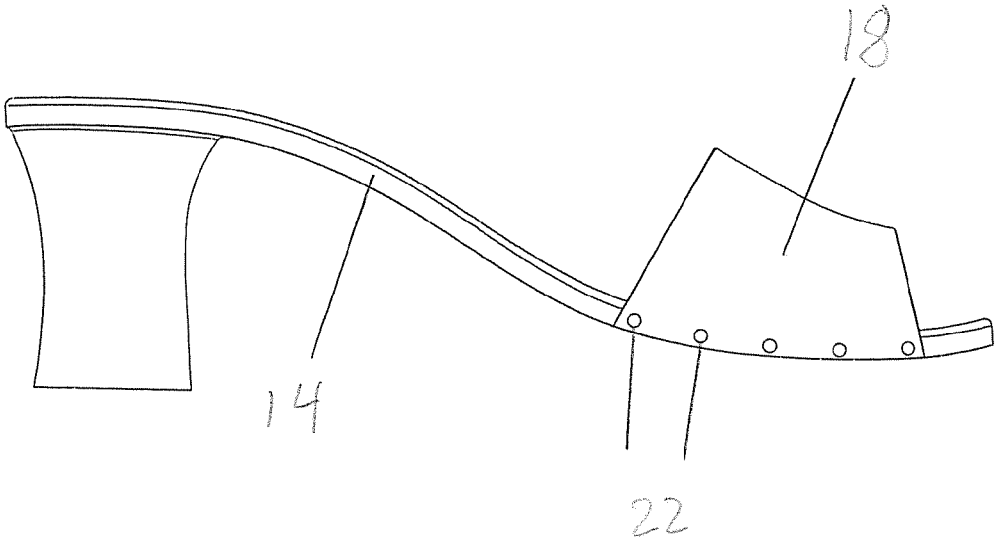
FIG. 14B is a right side view of the same footwear embodiment as shown in FIG. 12A and that includes a wider, higher heel element with a larger front replaceable cover and a more rounded toe shape and having bottom ornamental connection elements visible.
Figure 15A:
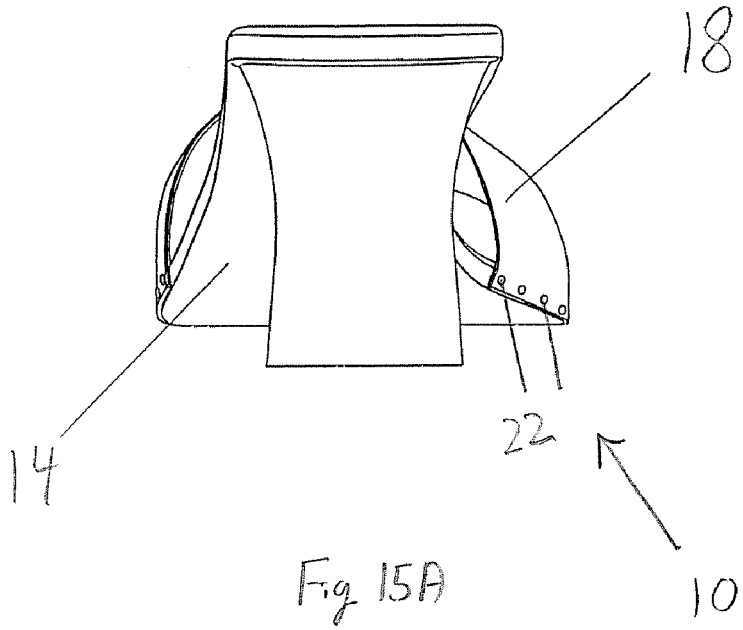
FIG. 15A is a back view of the footwear embodiment shown in FIG. 12A and that includes a wider, higher heel element with a larger front replaceable cover and a more rounded toe shape and having bottom ornamental connection elements visible.
Figure 15B:
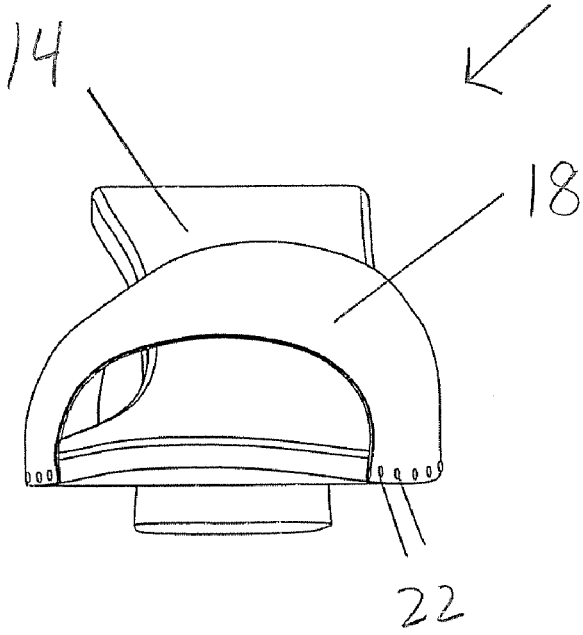
FIG. 15B is a front view of the same footwear embodiment as shown in FIG. 12A and that includes a wider, higher heel element with a larger front replaceable cover and a more rounded toe shape and having bottom ornamental connection elements visible.
Figure 16B:
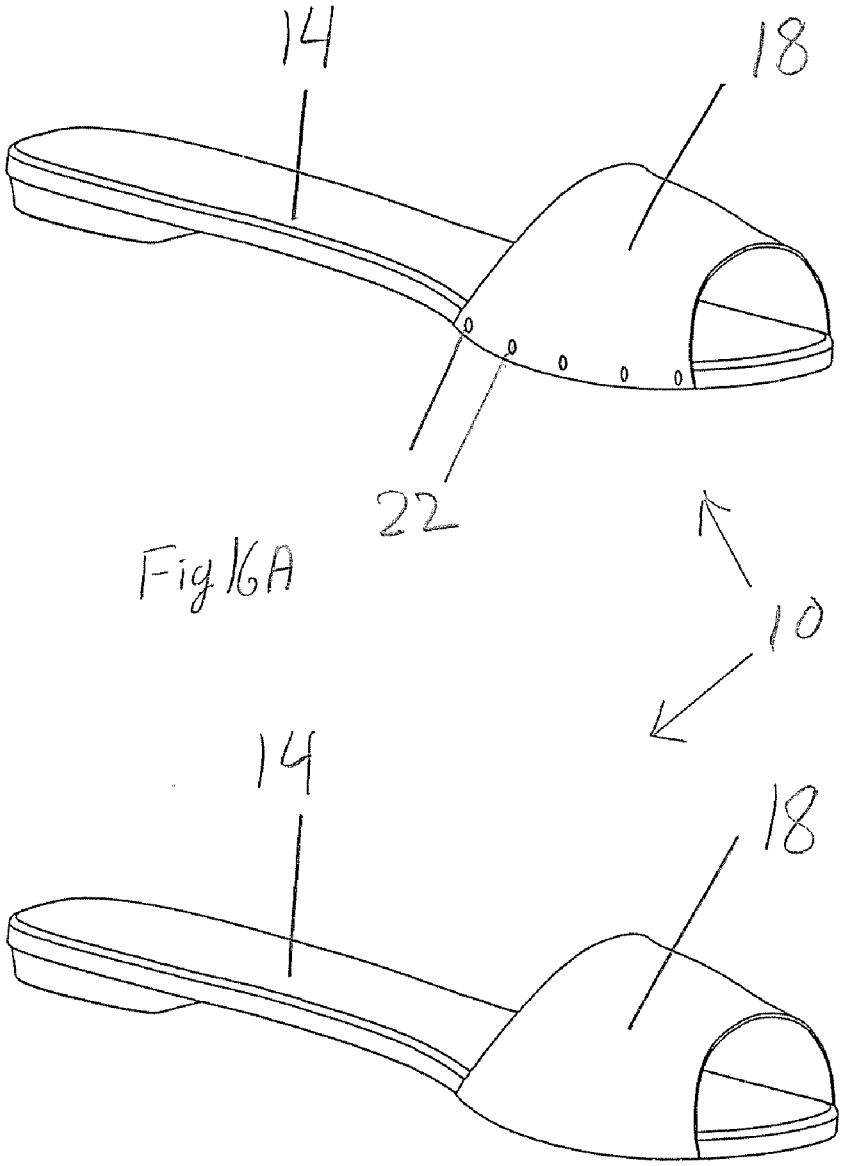
FIG. 16B is a perspective view of another footwear embodiment including a wider, lower heel element with a larger front replaceable cover and a more rounded toe shape without bottom connection elements being visible.
Figure 17A:
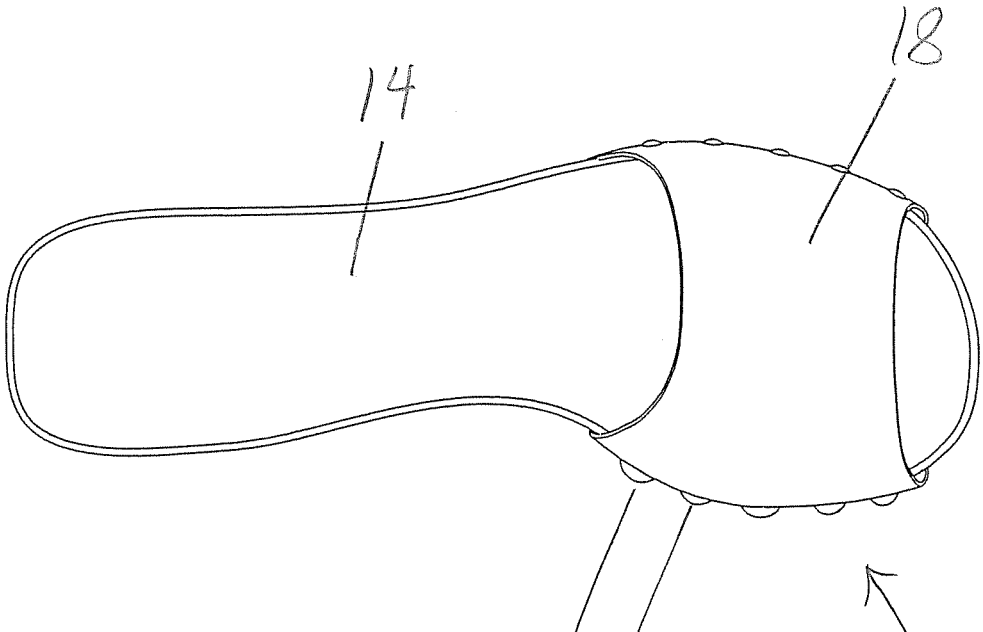
FIG. 17A is a top view of the footwear embodiment shown in FIG. 16A and that includes a wider, lower heel element with a larger front replaceable cover and a more rounded toe shape and having bottom ornamental connection elements visible to varying degrees.
Figure 17B:
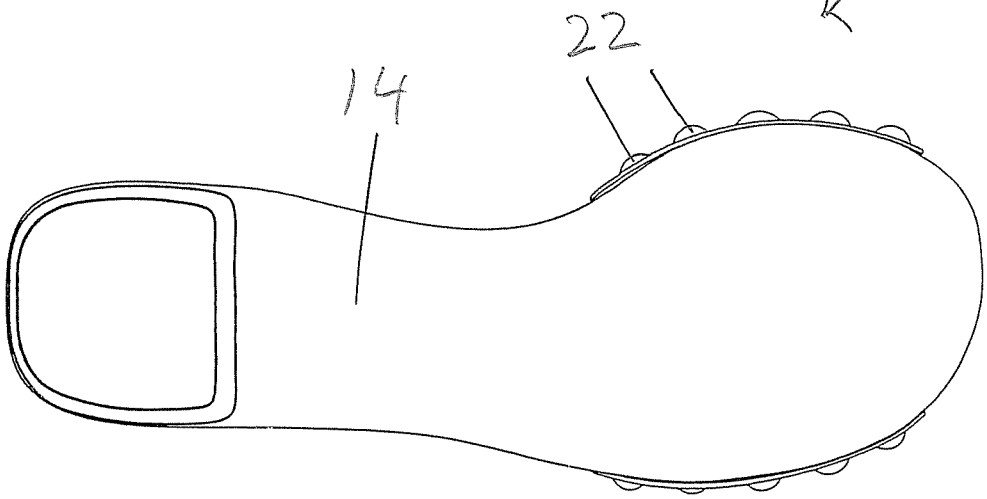
FIG. 17B is a bottom view of the footwear embodiment shown in FIG. 16A and that includes a wider, lower heel element with a larger front replaceable cover and a more rounded toe shape and having bottom ornamental connection elements visible.
Figure 18B:
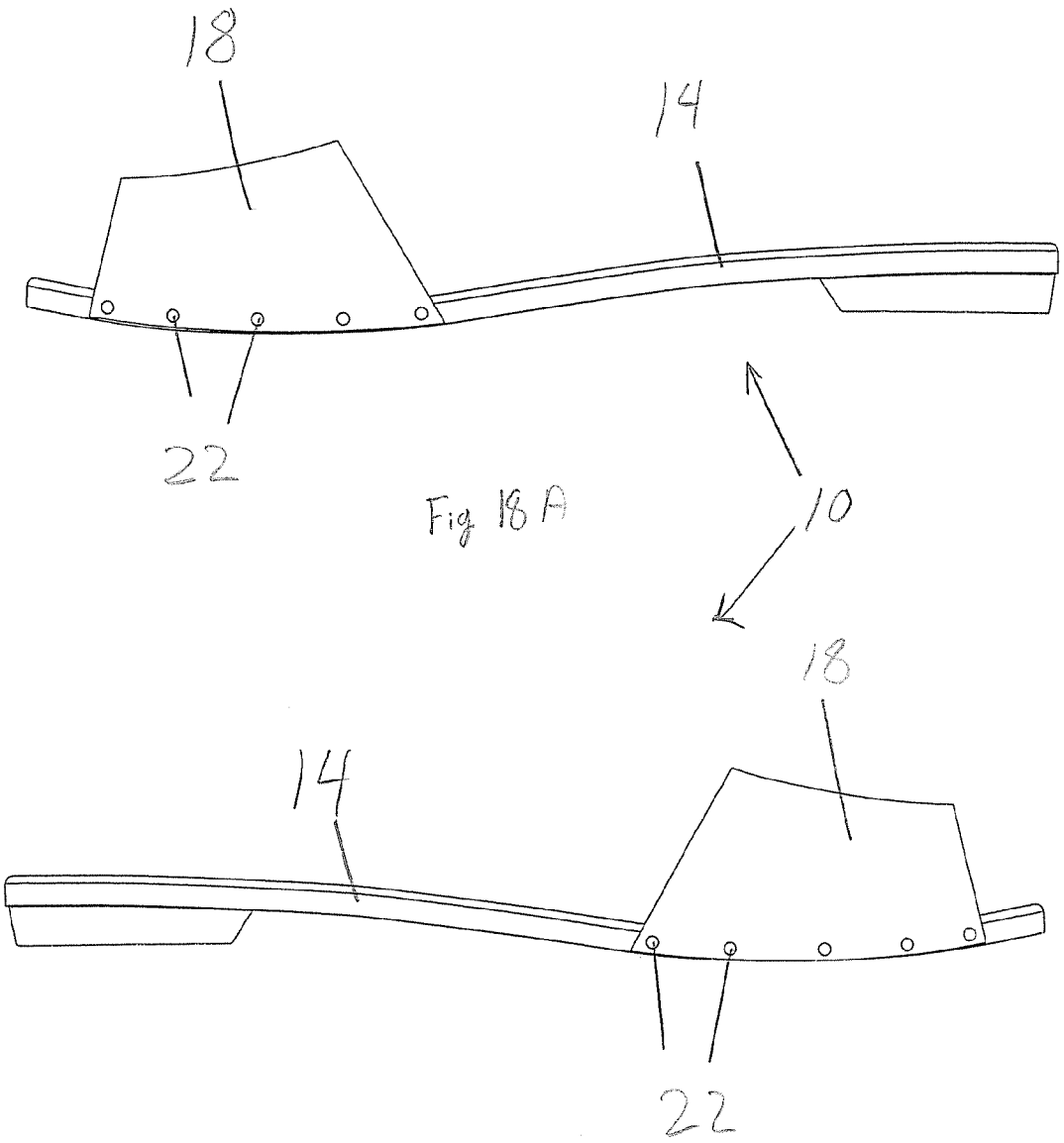
FIG. 18B is a right side view of the same footwear embodiment as shown in FIG. 16A and that includes a wider, lower heel element with a larger front replaceable cover and a more rounded toe shape and having bottom ornamental connection elements visible.
Figure 19A:
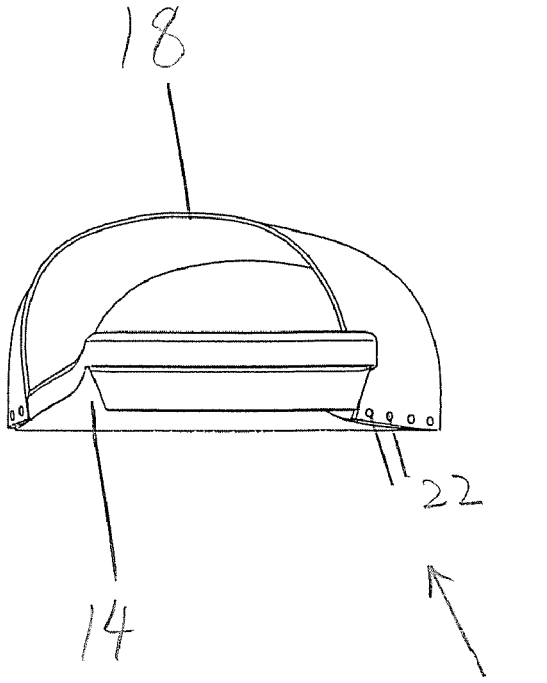
FIG. 19A is a back view of the footwear embodiment shown in FIG. 16A and that includes a wider, lower heel element with a larger front replaceable cover and a more rounded toe shape and having bottom ornamental connection elements visible.
Figure 19B:
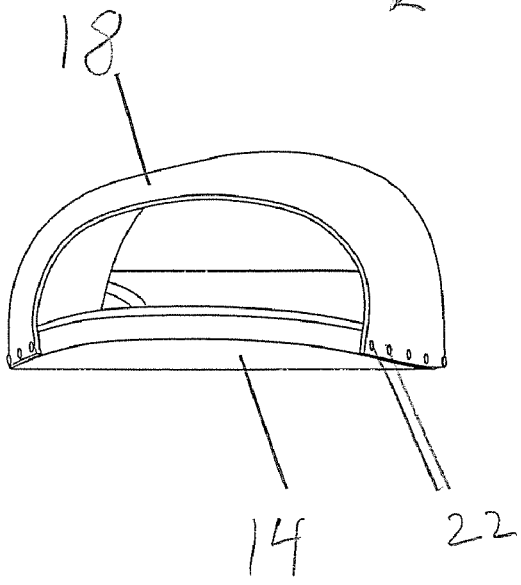
FIG. 19B is a front view of the same footwear embodiment as shown in FIG. 16A and that includes a wider, lower heel element with a larger front replaceable cover and a more rounded toe shape and having bottom ornamental connection elements visible.
Figure 20A:
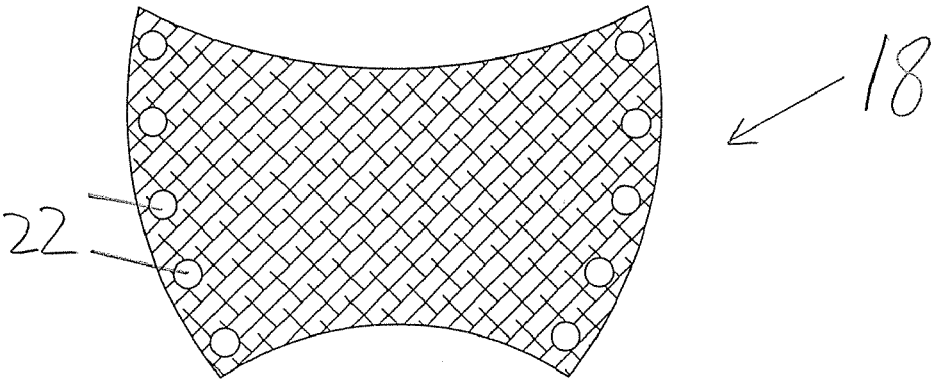
FIG. 20A is a plan view of a detached larger front replaceable cover having a finer, cross-hatched design and having bottom ornamental connection elements visible and that may be used with an item of footwear.
Figure 20B:
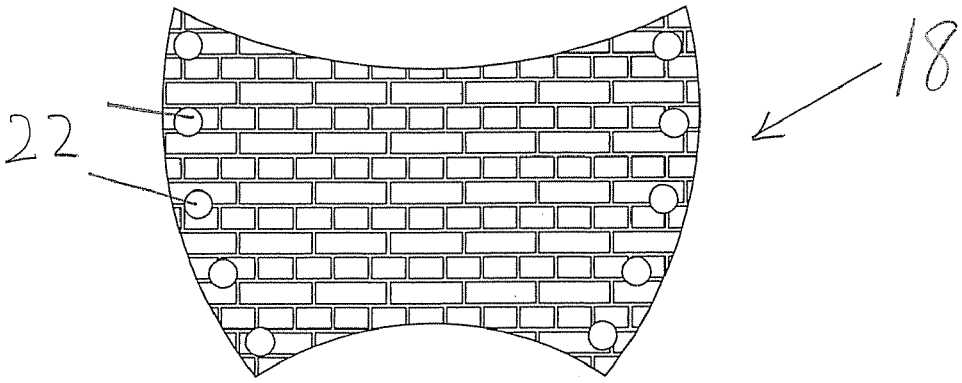
FIG. 20B is a plan view of a detached larger front replaceable cover having a broken striped design having bottom ornamental connection elements visible and that may be used with an item of footwear.
Figure 20C:
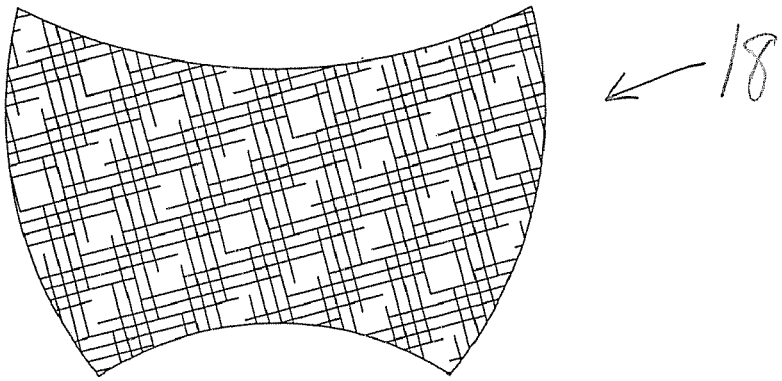
FIG. 20C is a plan view of a detached larger front replaceable cover having a coarser, cross-hatched design without having bottom ornamental connection elements visible and that may be used with an item of footwear.
Figure 21A:
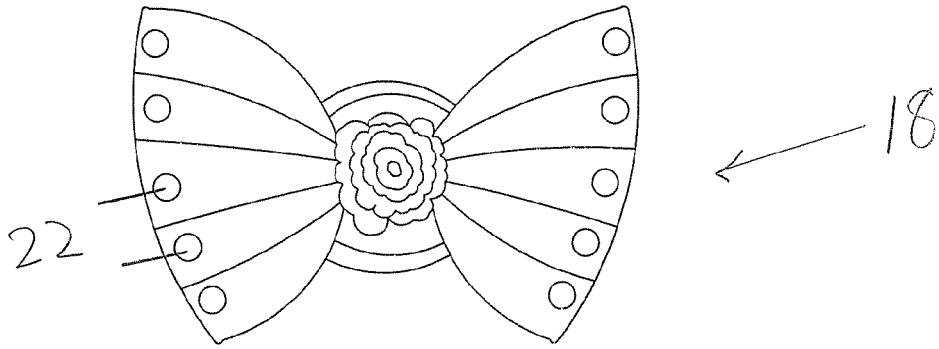
FIG. 21A is a plan view of a detached gathered front replaceable cover having a center floral-like design and having bottom ornamental connection elements visible and that may be used with an item of footwear.
Figure 21B:
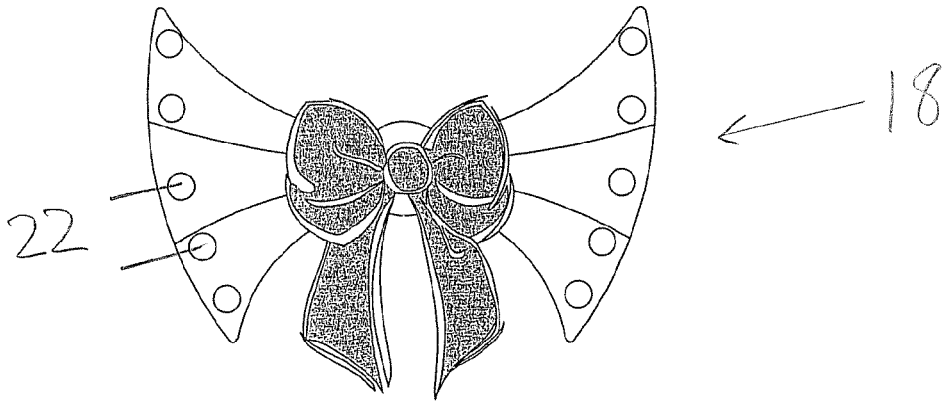
FIG. 21B is a plan view of a detached gathered front replaceable cover having a center bow design having bottom ornamental connection elements visible and that may be used with an item of footwear.
Figure 21C:
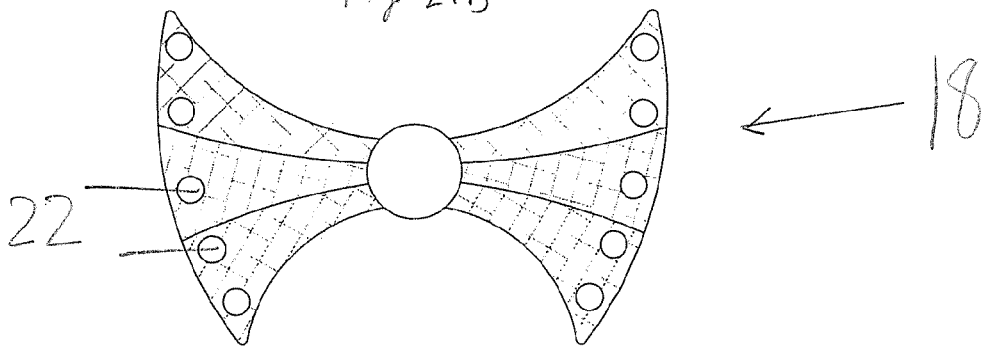
FIG. 21C is a plan view of a detached gathered narrower front replaceable cover having a center element design with fabric pattern having bottom ornamental connection elements visible and that may be used with an item of footwear.
Figure 22A:
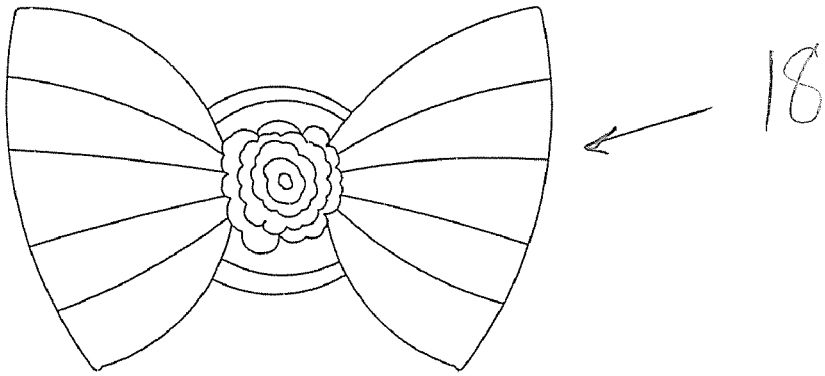
FIG. 22A is a plan view of a detached gathered front replaceable cover having a center floral-like design without having bottom ornamental connection elements visible and that may be used with an item of footwear.
Figure 22B:
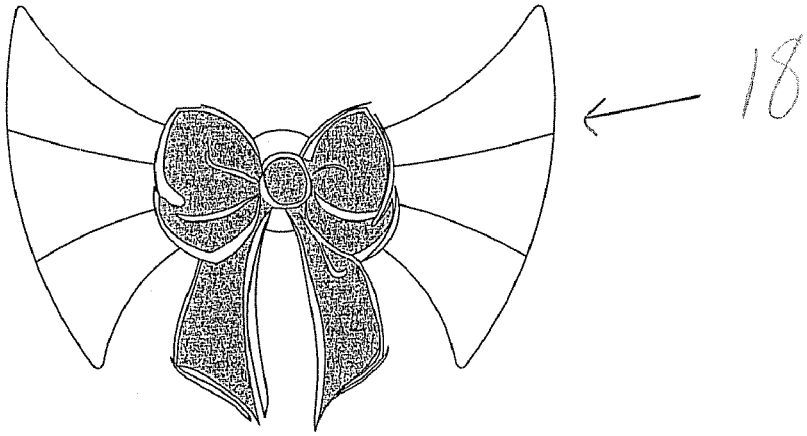
FIG. 22B is a plan view of a detached gathered front replaceable cover having a center bow design without having bottom ornamental connection elements visible and that may be used with an item of footwear.
Figure 22C:
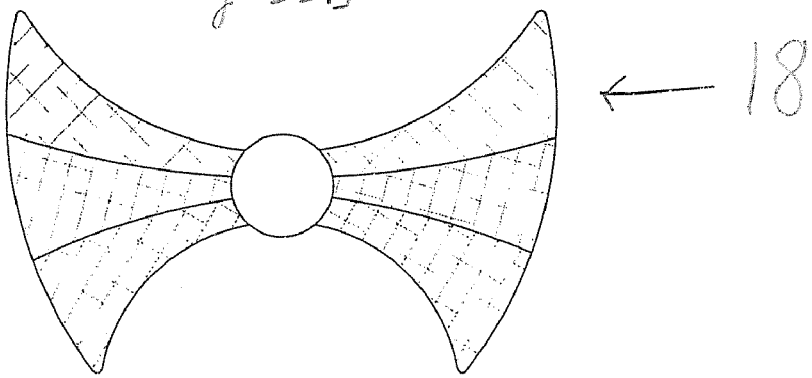
FIG. 22C is a plan view of a detached gathered front replaceable cover having a center element design with fabric pattern without having bottom ornamental connection elements visible and that may be used with an item of footwear.
Figure 23A:
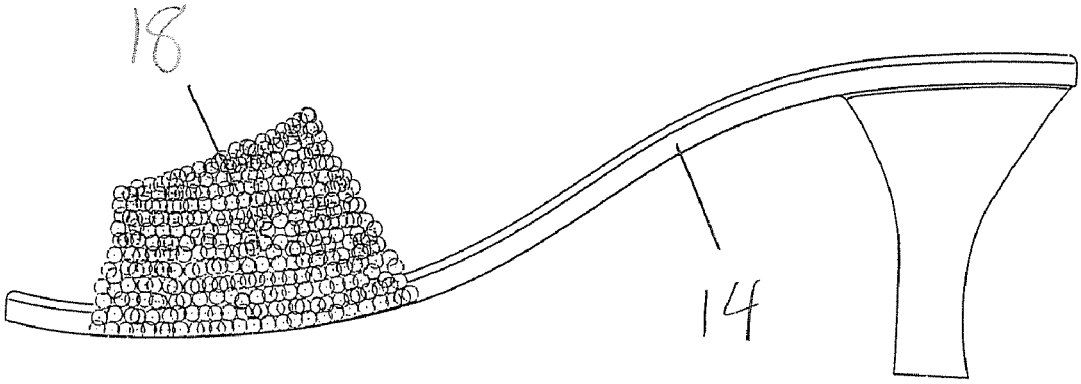
FIG. 23A is a left side view of a footwear embodiment shown that includes a narrower, higher heel element with a larger front replaceable cover having a sequined cover design and not having bottom ornamental connection elements visible.
Figure 23B:
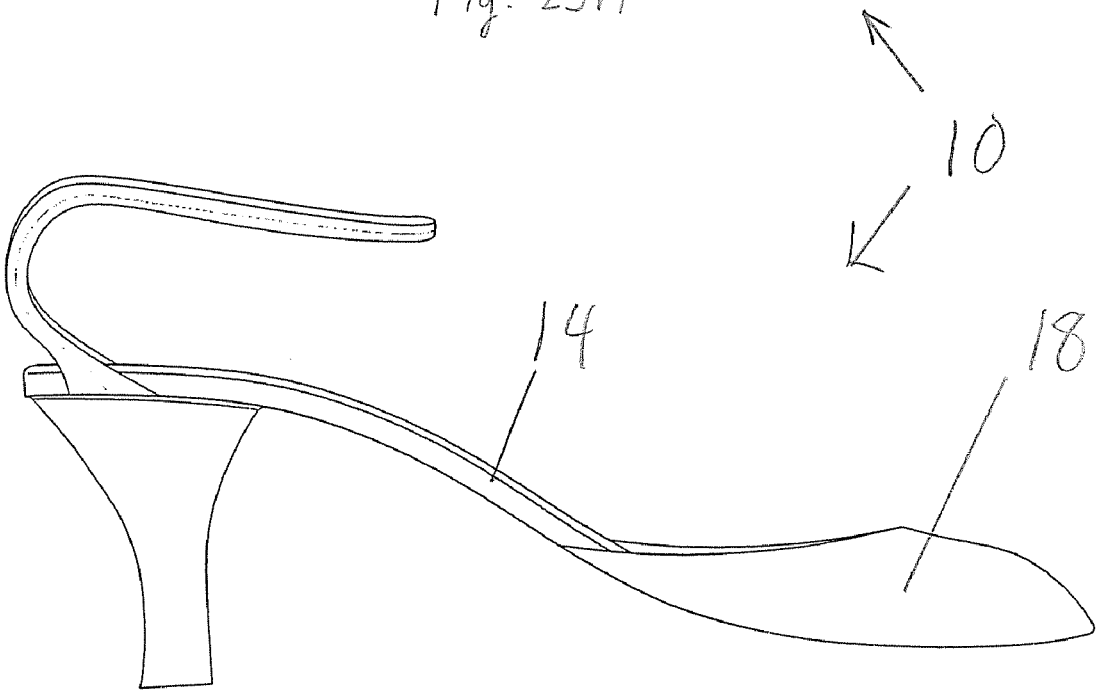
FIG. 23B is a right side view of an embodiment that includes a narrower, higher heel element with a covered front, perhaps replaceable cover, a rear, perhaps replaceable attachment strap and a more pointed toe shape without having bottom ornamental connection elements visible.
Figure 24A:
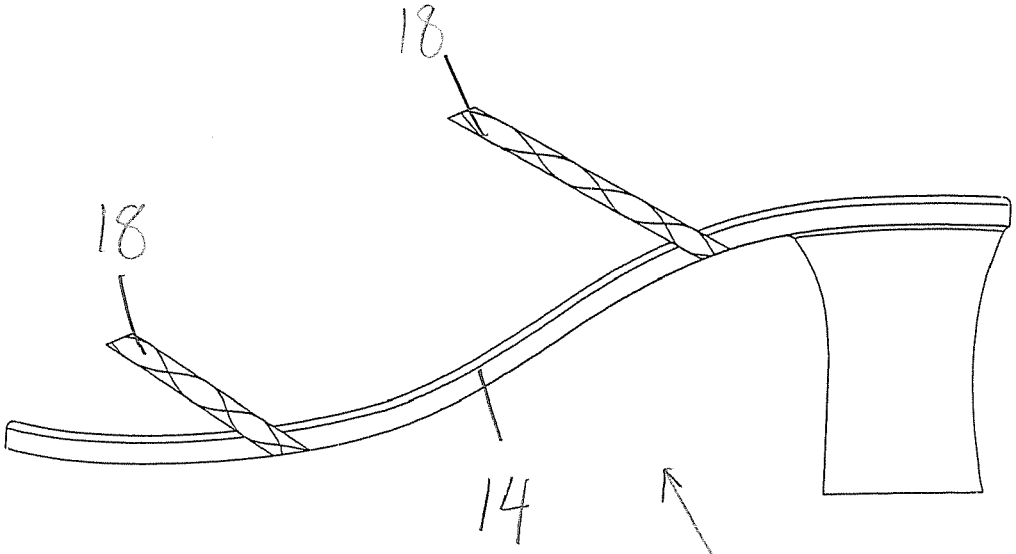
FIG. 24A is a left side view of a footwear embodiment shown that includes a wider, higher heel element with a thinner front, perhaps replaceable strap having a braided design (twisted as shown, but a three or more braid pattern may also be used) and also a thinner back, perhaps replaceable strap shown here as having a braided design and not having bottom ornamental connection elements visible.
Figure 24B:
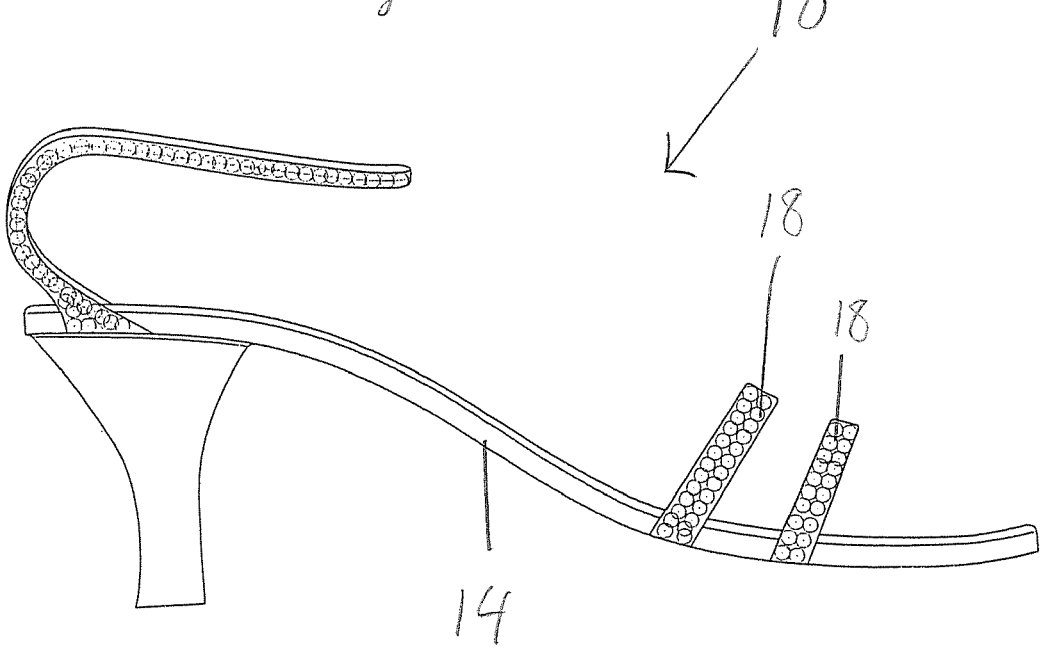
FIG. 24B is a right side view of an embodiment that includes a narrower, higher heel element with two thinner front, perhaps replaceable straps having sequined designs and a rear, perhaps replaceable attachment strap having a sequined design and without having bottom ornamental connection elements visible.
Figure 25A:
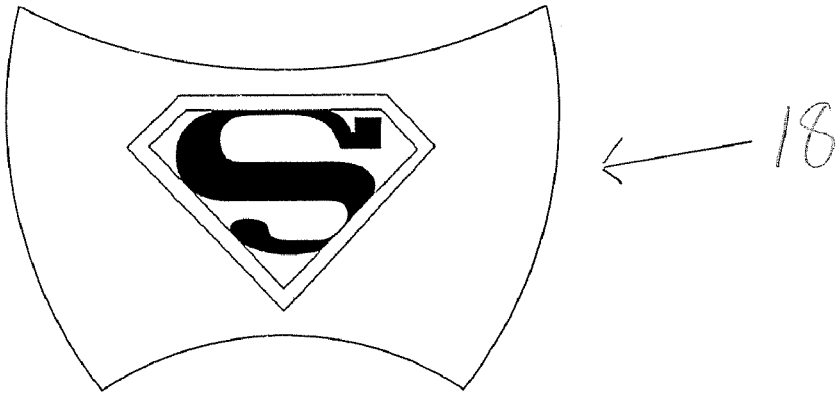
FIG. 25A is a plan view of a detached larger front replaceable cover having a popular logo design (in this case a movie and comic book character's design, although different popular character designs, corporate logos, and other designs might also be used) without having bottom ornamental connection elements visible and that may be used with an item of footwear.
Figure 25B:
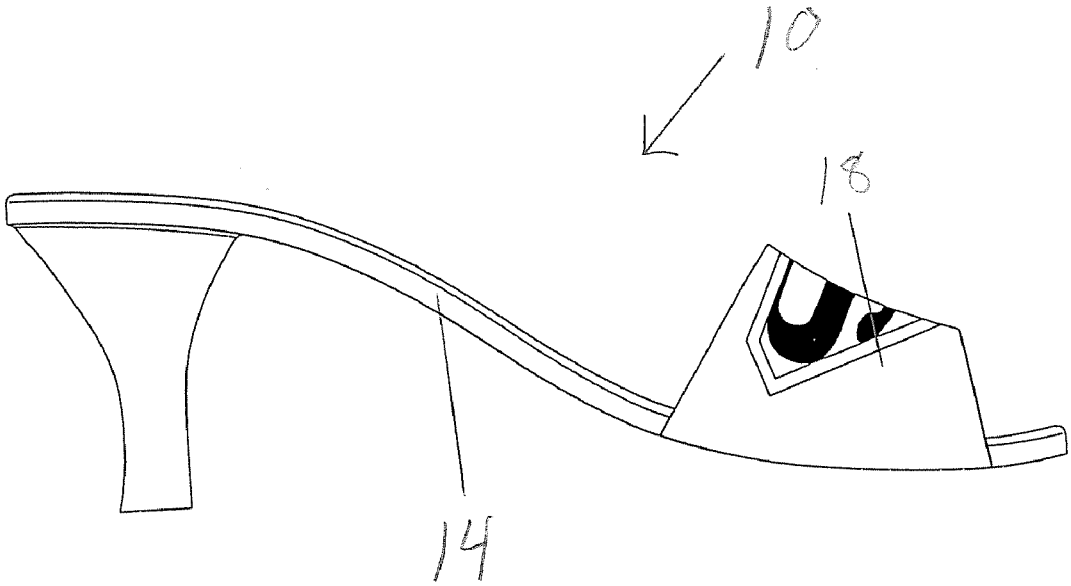
FIG. 25B is a right side view of an embodiment that includes a narrower, higher heel element with a larger front replaceable cover having the popular logo design shown in FIG. 25A and a more rounded toe shape and without having bottom ornamental connection elements visible.
Figure 26A:
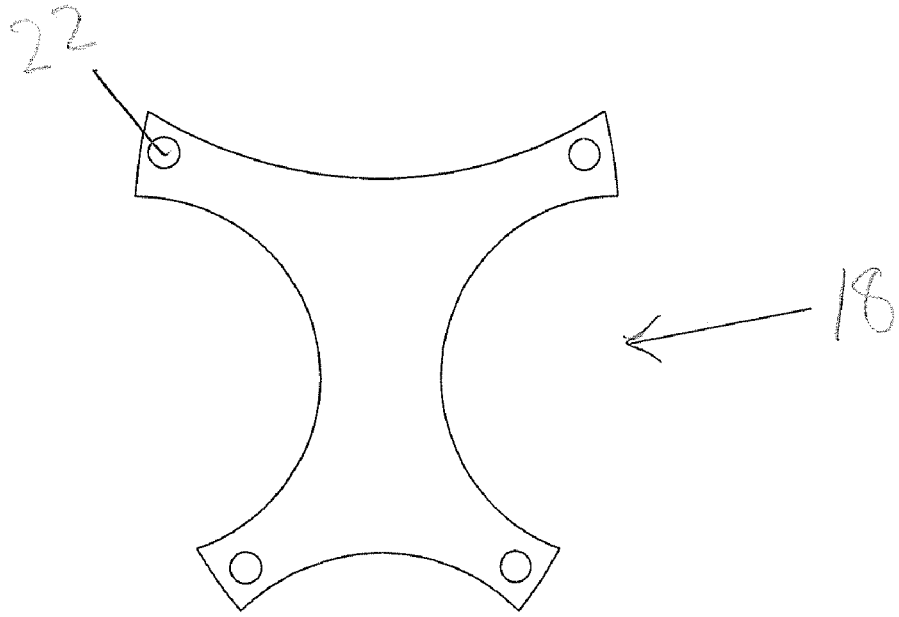
FIG. 26A is a plan view of a detached hyperbolically-shaped front replaceable cover having bottom ornamental connection elements visible and that may be used with an item of footwear.
Figure 26B:
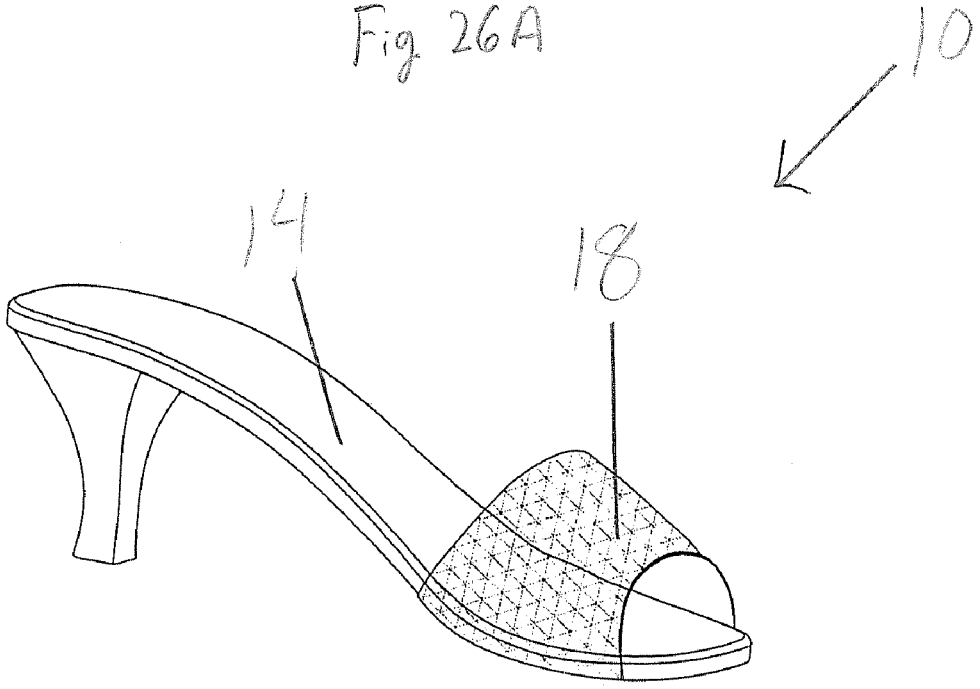
FIG. 26B is a perspective view of a footwear embodiment including a narrower, higher heel element with a larger front replaceable cover intended to depict general fishnet designs and a more rounded toe shape without connection elements being visible.
Figure 27A:
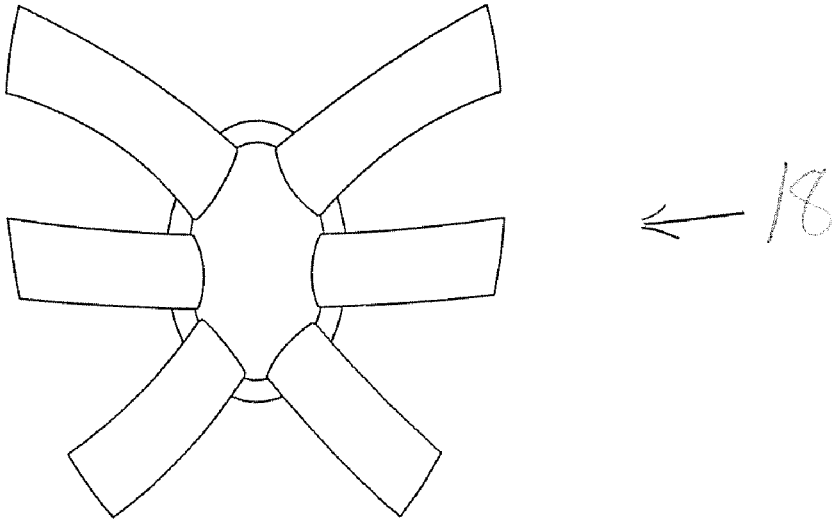
FIG. 27A is a plan view of a detached center ring front replaceable cover having no bottom ornamental connection elements visible and that may be used with an item of footwear.
Figure 27B:
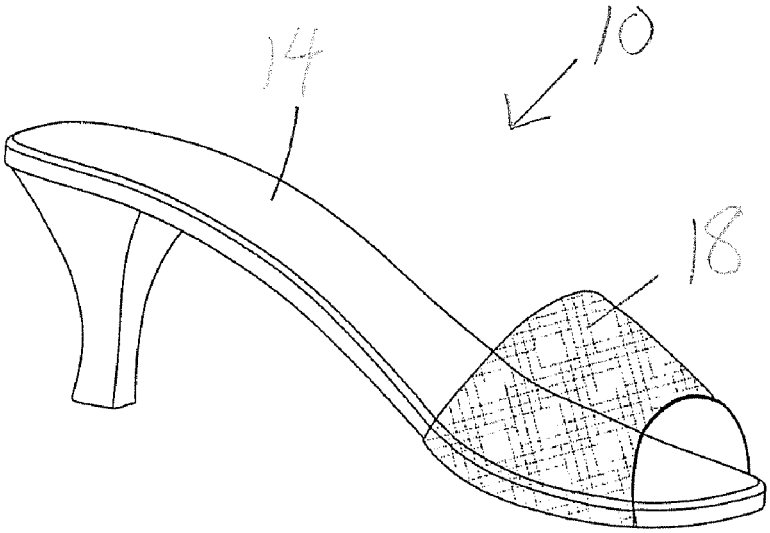
FIG. 27B is a perspective view of a footwear embodiment including a narrower, higher heel element with a larger front replaceable cover having a medium weave design and a more rounded toe shape without connection elements being visible.
Figure 28A:
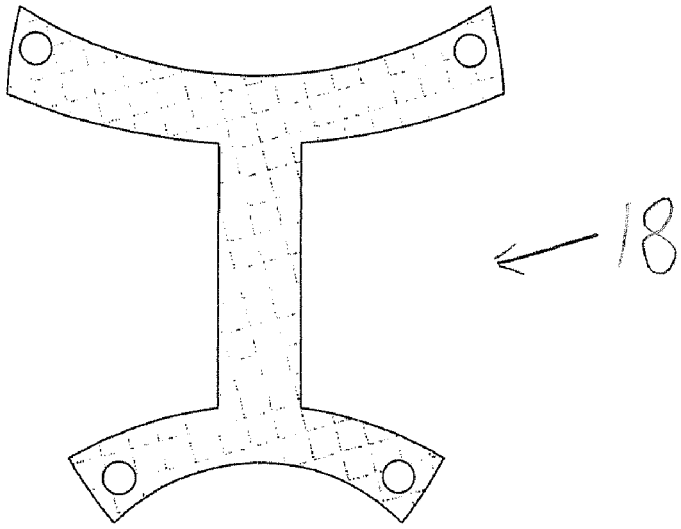
FIG. 28A is a plan view of a detached I-shaped front replaceable cover having bottom ornamental connection elements visible and that may be used with an item of footwear.
Figure 28B:
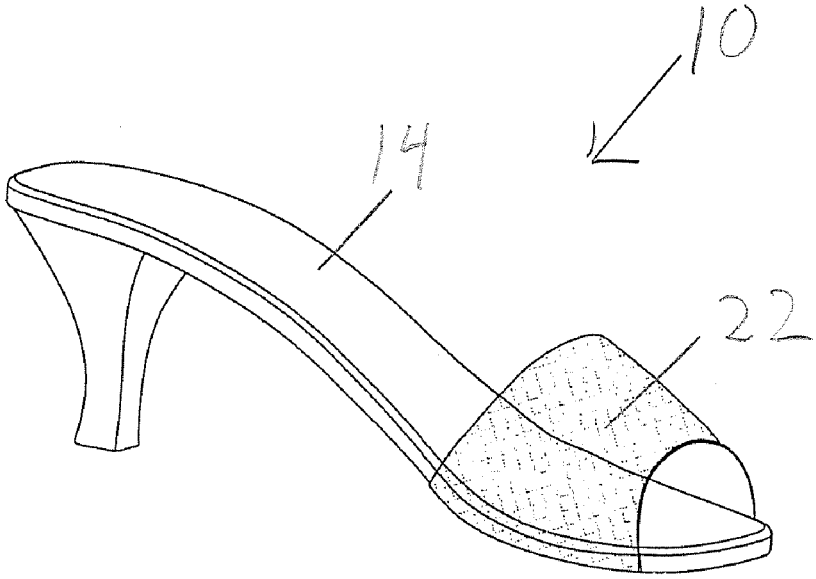
FIG. 28B is a perspective view of a footwear embodiment including a narrower, higher heel element with a larger front replaceable cover having a checkered design and a more rounded toe shape without connection elements being visible.
Figure 29A:
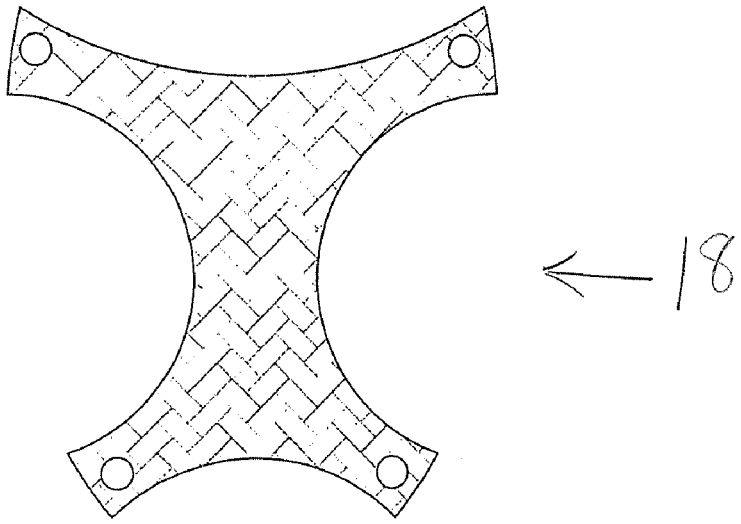
FIG. 29A is a plan view of a detached hyperbolically-shaped front replaceable cover having a coarse weave design and having bottom ornamental connection elements visible and that may be used with an item of footwear.
Figure 29B:
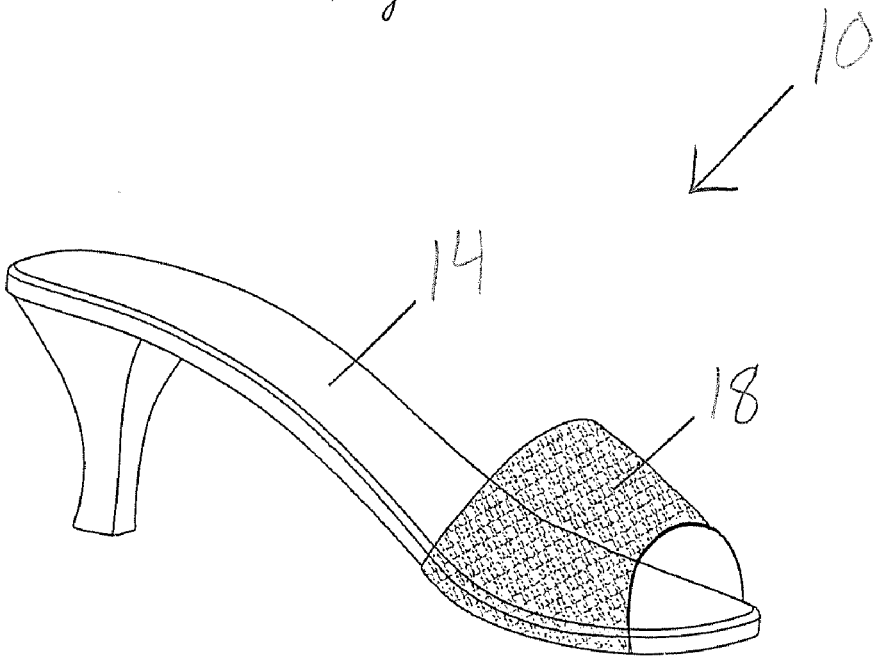
FIG. 29B is a perspective view of a footwear embodiment including a narrower, higher heel element with a larger front replaceable cover having a chain-mail design and a more rounded toe shape without connection elements being visible.
Figure 30B:
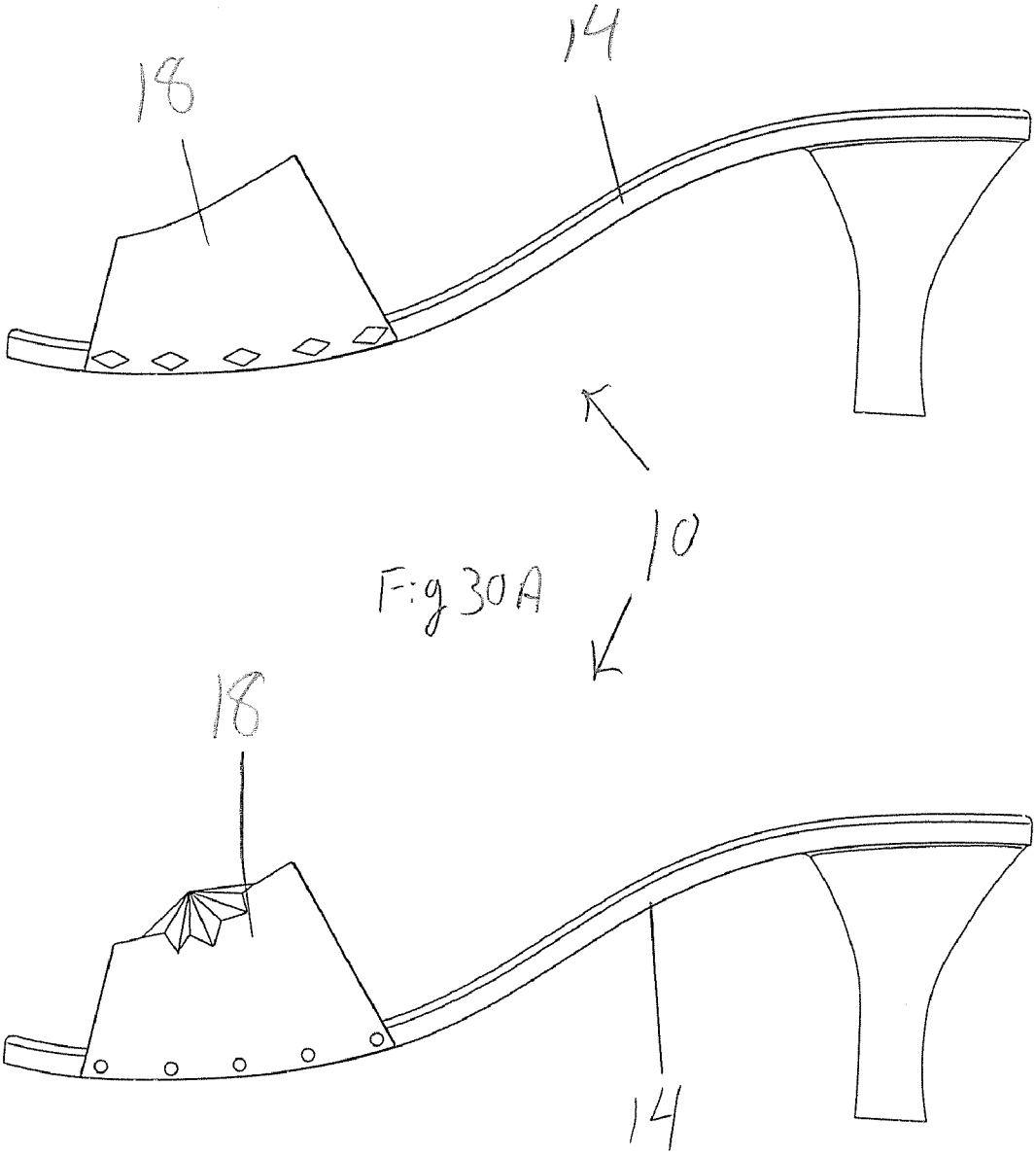
FIG. 30B is a left side view of the footwear embodiment that includes a narrower, higher heel element with a larger front replaceable cover having a center appliqué in this case a larger single gem design (although other appliqués, images, and designs might also be used, such as dragon appliqués or the like) and a more rounded toe shape and having bottom ornamental connection elements visible.
Figure 31A:
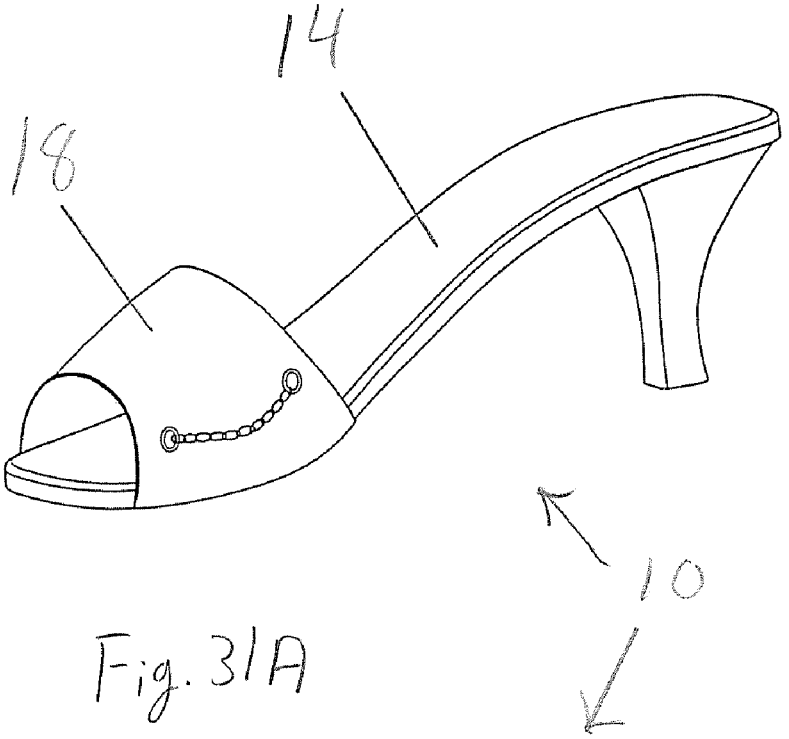
FIG. 31A is a left side view of the footwear embodiment shown that includes a narrower, higher heel element with a larger front replaceable cover having a design with side chains and a more rounded toe shape without bottom ornamental connection elements visible.
Figure 31B:
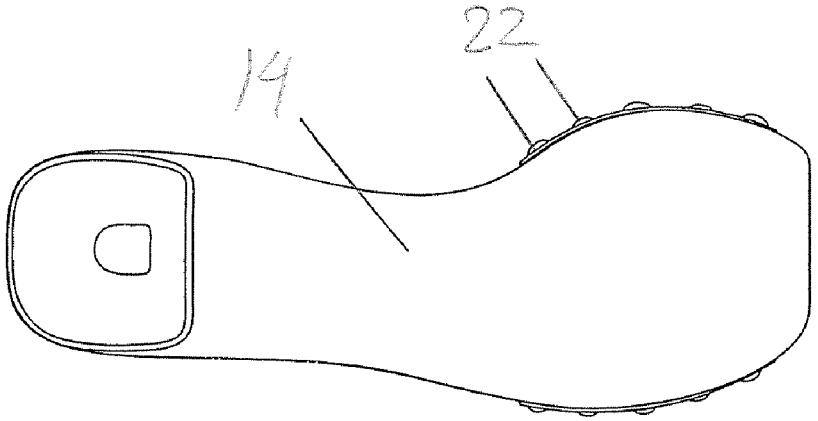
FIG. 31B is a bottom view of a footwear embodiment that includes a narrower, higher heel element with a more squared toe shape and having bottom ornamental connection elements visible.
Figure 32:
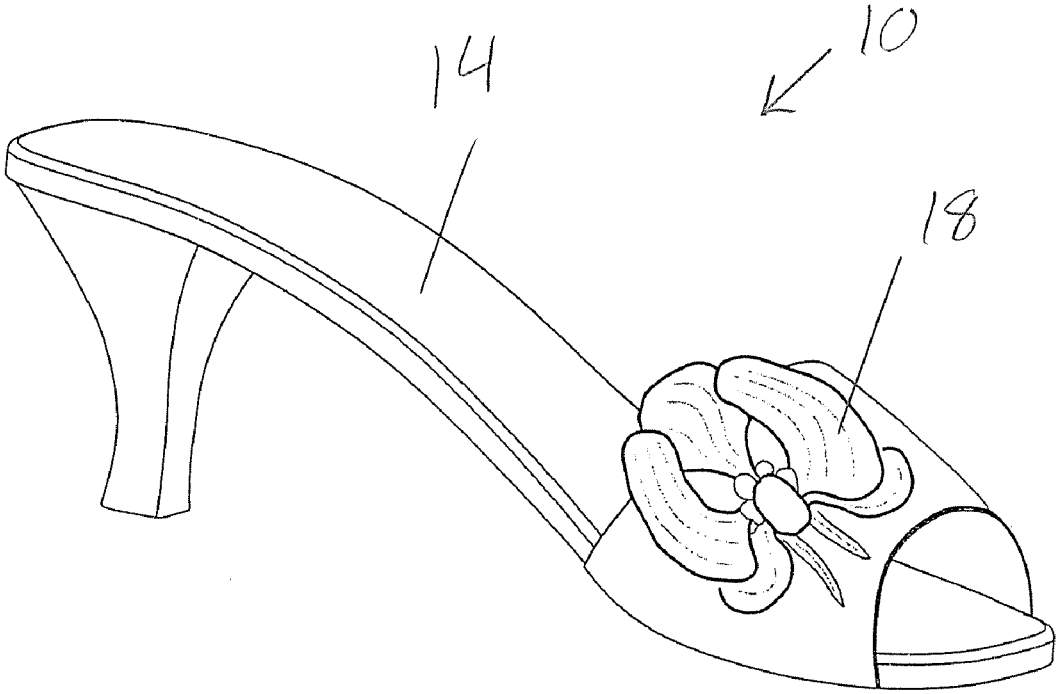
FIG. 32 is a perspective view of another footwear embodiment including a narrower, higher heel element with a larger front, perhaps replaceable cover having an off-center, outside floral component (in this case intended to represent an orchid design, but other floral designs might also be used) and a more rounded toe shape without connection elements being visible.

In accordance with embodiments of the present invention, uppers 18 can include a wide variety of different designs. FIGS. 2B-19, 23, 24, 30-32 all illustrate platform shoes with detachable uppers 10 with different uppers 18 in accordance with embodiments of the present invention. As described above, some uppers 18 have visible snaps and others do not. FIG. 4A shows the male snap component 22*a* disposed on the lower 14 and the female snap component 22*b* disposed on the upper 18. An upper 18 can be a single strap that goes across an instep as illustrated in, for example, FIGS. 2B, 3B, 8 and 17. Alternatively, as illustrated in FIG. 7B, the upper 18 may wrap completely around the front of the toe box and surround an entire front portion of the shoe. FIG. 7A illustrates an embodiment of the present invention that features an upper 18 that surrounds approximately ⅔ of the foot. Uppers 18 may be a uniform shape or angle down toward a toe box. FIGS. 5A, 5B, and 24 illustrate embodiments of the present invention that feature uppers 18 containing multiple straps. A peep toe upper 18 is shown in FIG. 14. A sling back upper 18 is shown in 7B. In accordance with embodiments of the present invention, uppers 18 may include full coverage around a front of the foot. Uppers 18 in accordance with embodiment of the present invention, may be made of leather, fabric, or other materials and may also contain appliqué fashion accessories, such as bows, flowers, decorative jewelry, cut out designs, or the like. FIGS. 20-22 and 25-29 show additional styles of uppers in accordance with embodiments of the present invention. As can be understood from the various drawings, an upper may include any style, any color, any material, any shape, any decorative features, and the like and all are meant to be included in this disclosure.

In accordance with embodiments of the present invention, a platform snap shoe 10 includes a lower shoe member 14 that features a platform base 26 made of plastic, rubber, microfiber, synthetic, wood, or the like. As previously noted, FIGS. 1A, 1B, and 1C illustrate lower shoe members 14 with platforms bases 26 within the scope of the present invention. A platform base 26 may begin at the front of the toe box and may go as far back as the designer desires. Of course, other platform base 26 examples are possible and all are meant to be included in this disclosure. A platform component 26 may be custom designed for each specific shoe. As shown in FIG. 1B, a platform component 26 may start at a toe box and continue all the way to the back of a shoe. Alternatively, as shown in FIG. 1C, a platform component 26 may go only halfway back across the foot and taper away so that it may eventually flush with the original thickness of a standard mid-sole. In some embodiments, it may also be possible to have a platform base 26 go the entire length of the shoe and even to include a heel that is fixed as part of a platform base 26. In this case, a separate heel may not need to be added prior to mounting a sole to a platform base 26.

A lower shoe member 14 that features a platform base 26 is comprised of several elements. In general the platform base is comprised of platform that is wrapped in a material such as leather. Additional fiberboard may be placed on top of the platform to provide supplemental support and padding. A metal shank may be included to provide extra support. The platform may include a heel shaped portion. The entire lower shoe member 14 may be covered in leather. The leather may cover the additional fiberboard or, alternatively, leave the fiberboard exposed. In the case of a platform that feature a heel shaped portion, the leather may also cover the heel shaped portion. Alternatively, a finished heel may be nailed, glued, or otherwise attached separately to the covered lower shoe member 14. A leather sole may then be attached to the platform component to create a "platform base."

In accordance with embodiments of the present invention, when platform shoes with detachable uppers 10 are constructed, a snap(s) (or other attachment elements) may be placed onto a platform component portion only. The thickness of the platform component provides an area suitable for the attachment of the snaps 22. Shoes constructed without a platform component have been found to lack an attachment area that provides sufficient durability for the shoe when in use. Snaps 22 with improved strength, such as "nautical snaps" may optionally be used in order to provide a more secure connection between the upper 18 and the lower 14. Alternatively, the shoe platform 26 may be shaped so as to distribute pressure caused by the weight of the wearer in such way that a reduced stress is placed on the snaps 22. Uppers 18 are preferably attached to a lower 14 by snaps 22, however other means of attachment are within the scope of the invention. For example, an attachment element may include snaps, hooks, loops, clips, and the like.

In accordance with embodiments of the present invention, the lower shoe member 14 includes specially adapted snaps or other design elements that provide protection for the shoe leather. It has been found that the edges of the snaps attached to the base 14 will tend to cut into the shoe leather over time and contribute to degradation of the shoe. Accordingly, embodiments of the present invention include means for protecting the shoe leather form the sharp edges of the snaps. In particular, the snap edges may be burnished or otherwise dulled to prevent cutting of the leather. Alternatively, or in combination, a barrier or protective layer may be provided between the snaps and the leather.

Figure 33:
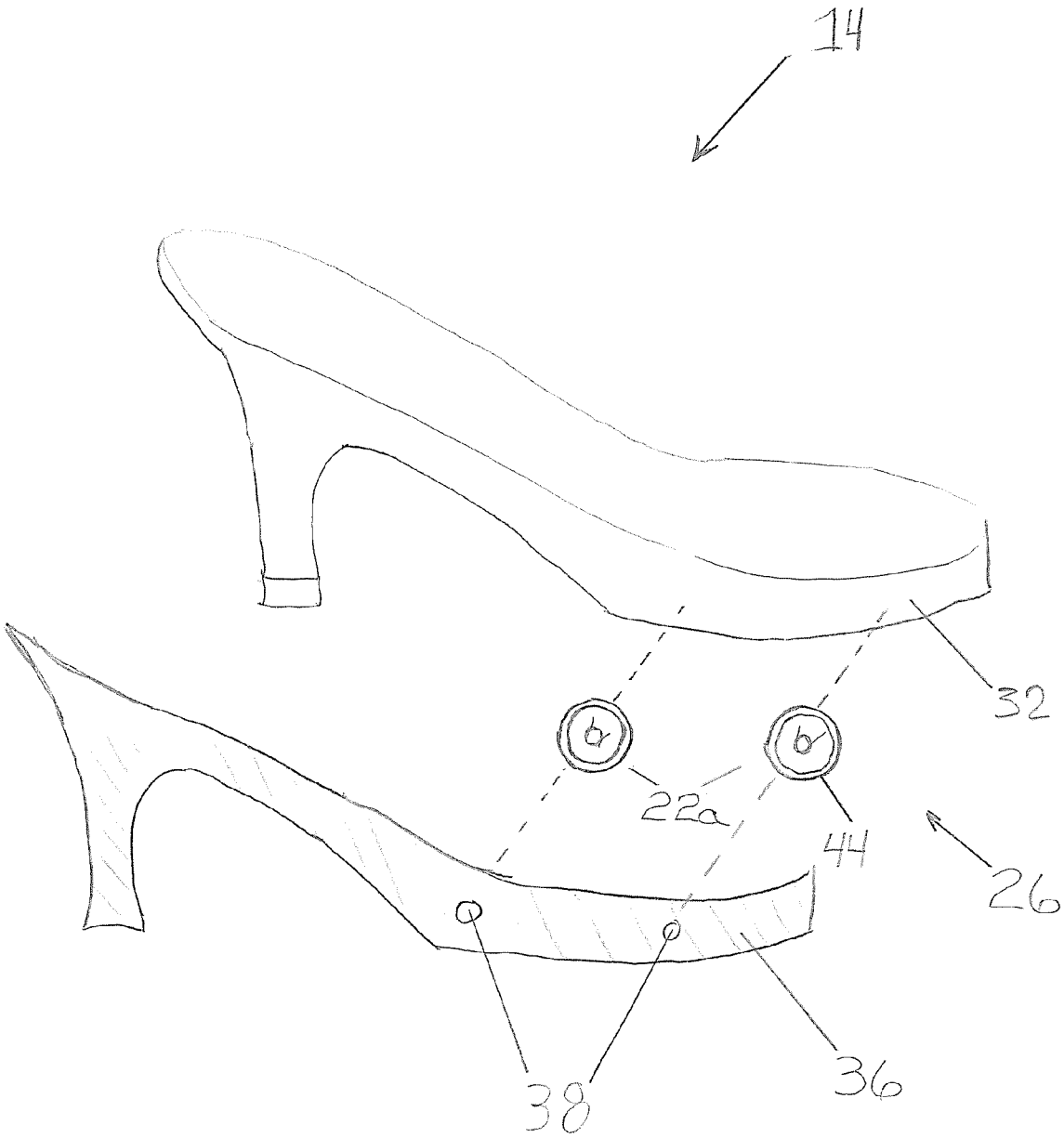
FIG. 33 is an exploded view of the lower shoe member showing the interconnection between elements of an embodiment of the present invention.

FIG. 33 illustrates an interconnection between elements of a lower shoe member 14 in accordance with embodiments of the present invention. Shown therein is a lower shoe member 14 containing a platform base 26. The lower shoe member includes a platform 32, snaps 22*a* attached to the platform, and leather 36 covering the platform and a portion of the snaps 22*a*. As is known, snaps 22 contain a male 22*a* and female 22*b* components. The snap 22*a*, shown in FIG. 33, is the male portion 22*a* and is disposed between the platform 32 and the leather 36. The leather 36 contains holes 38 that allow a portion of the male snap component 22*a* to protrude through the leather 36 for attachment with the female snap component 22*b* disposed on an upper 18. As shown in FIG. 33, the snaps 22*a* feature a region 44 that has been burnished to provided the snaps 22*a* with dull edges.

Figure 34:
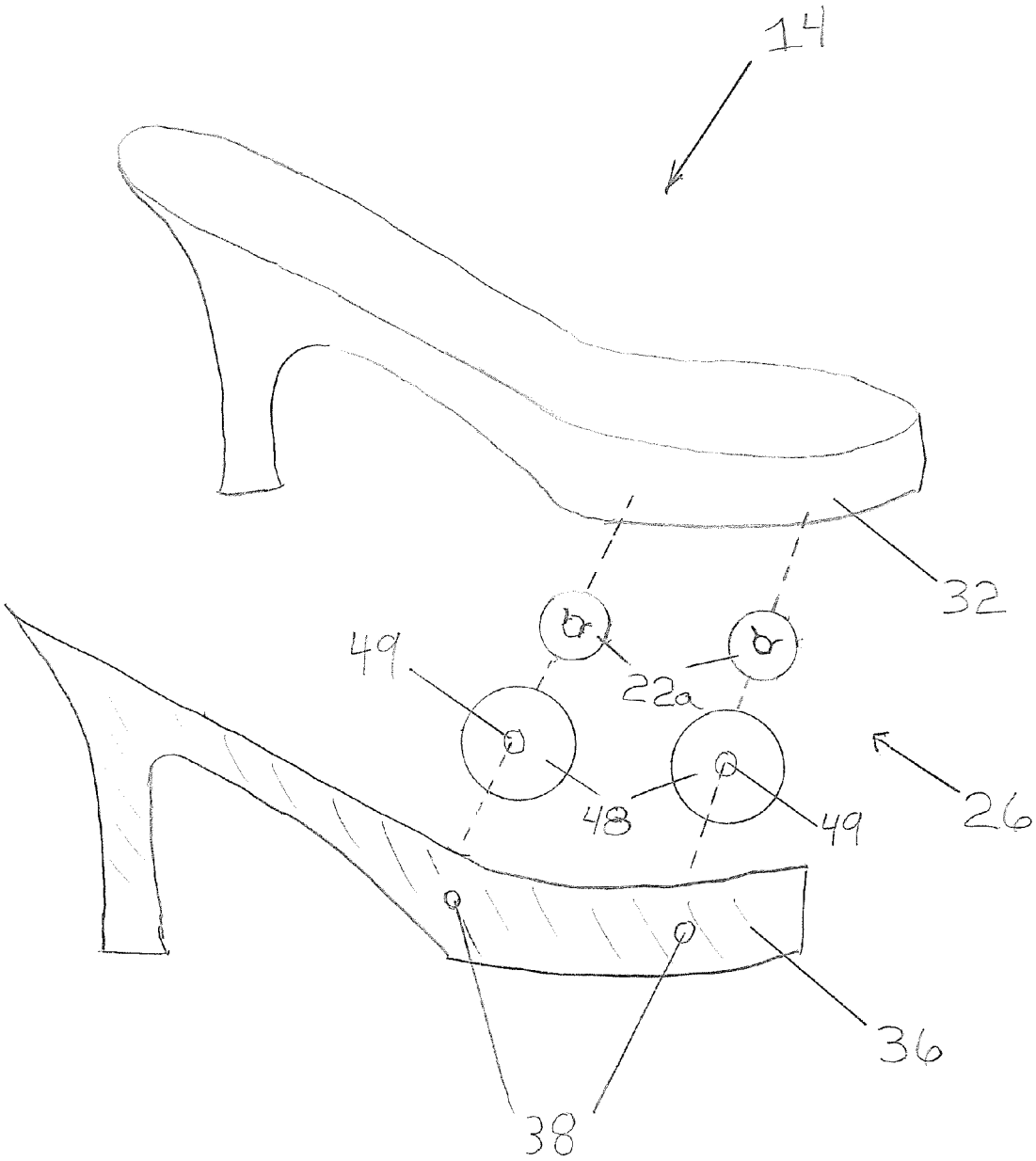
FIG. 34 is an exploded view of the lower shoe member showing the interconnection between elements of an embodiment of the present invention.

FIG. 34 illustrates an interconnection between elements of a lower shoe member 14 including a protective layer or a barrier member 48 in accordance with embodiments of the present invention. Shown therein is a lower shoe member 14 containing a platform base 26. The platform base includes a platform 32, snaps 22*a* attached to the platform, and leather 36 covering the platform 32 and a portion of the snaps 22*a*. The snaps 22*a*, shown in FIG. 34, are male snap components 22*a* and are disposed between the platform 32 and the leather 36. The doughnut shaped barrier 48 provides protection for the shoe leather 36. The barrier has a diameter larger than that of the snap 22*a*. As a result, the edges of the snap are prevented from contacting the shoe leather 36. The hole 49 in the center of the barrier 48 allows a portion of the male component of the snap to protrude through the barrier. This portion of the male snap component 22*a* further protrudes through holes 38 in the leather for engagement with the female snap component 22*b* of the snap disposed on the upper 18.

Other shapes and configurations of the barrier 48 are within the scope of the invention. For example, the barrier may be a strip a material laid down over the snaps 22*a* after the snaps 22*a* have been attached to the platform 32 and before the leather 36 has been attached. A hole is then cut in the barrier material to allow a portion of the male snap component 22*a* of the snap to protrude through.

Figure 35:
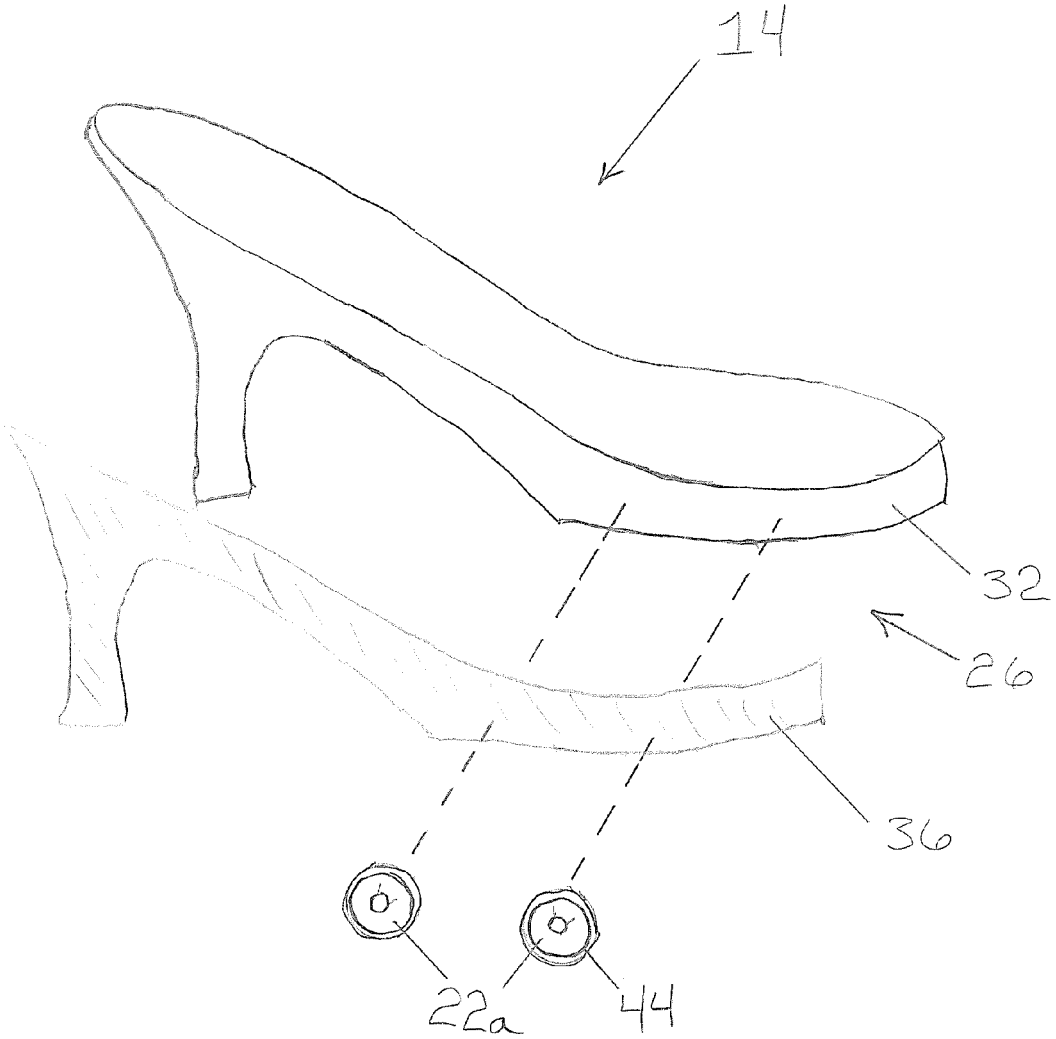
FIG. 35 is an exploded view of the lower shoe member showing the interconnection between elements of an embodiment of the present invention.

In accordance with embodiments of the present invention, the snaps 22 may be attached on the external surface of the covering material. FIG. 35 illustrates an interconnection between elements of a lower shoe member 14 having snaps 22*a* attached to the external surface of the leather 36. The snaps 22*a* include burnished edges 44 that prevent the snaps 22*a* from damaging the leather 36. Alternatively, or in addition to burnishing the edges of the snaps 22*a* a barrier may be provided between the snaps 22*a* and the leather 36. In this embodiment the barrier would be located behind the snap so as to be between the snaps 22*a* and the leather 36. In this embodiment of the present invention and others discussed above, leather is used to cover the platform 32. Alternatively, other material, such polyester, synthetic fiber or rubber, may be used to cover the platform 32.

In accordance with embodiments of the present invention, the placement of the snaps 22 (or other connector elements as discussed herein) on the platform base 26 may be done so that various patterns and styles of uppers may be interchangeable on the same lower shoe member 14 and, in at least some embodiments, so that the various uppers may be interchangeable on different lower shoe members 14. Uppers may include flexible elastic materials, which may allow an interchange with different lower shoe members 14 that feature different platforms, and perhaps even different platform base heights. The upper may stretch so as to accommodate different orientations and placements of the connector components on different lower shoe members 14. As an example, leather upper made for a low heel platform base may not fit well on a high heel platform base. However, providing a flexible upper may allow the interchangeability on different bases such as perhaps different platform bases 14. Flexible uppers may include a partial flexible upper 18, such as an elastic band sewn to a material such as a leather, fabric, or the like, or may even include an upper made entirely of elastic material. A flexible material may include, but is not limited to, elastic fabric, elastic materials, elastic webbings, stretch knits, stretch materials, stretch fabrics, rubber materials, spandex materials, elastane materials, and the like. Prior art uppers are made specifically for one heel height. In contrast, uppers in accordance with embodiments of the present invention are made using elastic materials may be interchanged on different platform bases.

Figure 36:
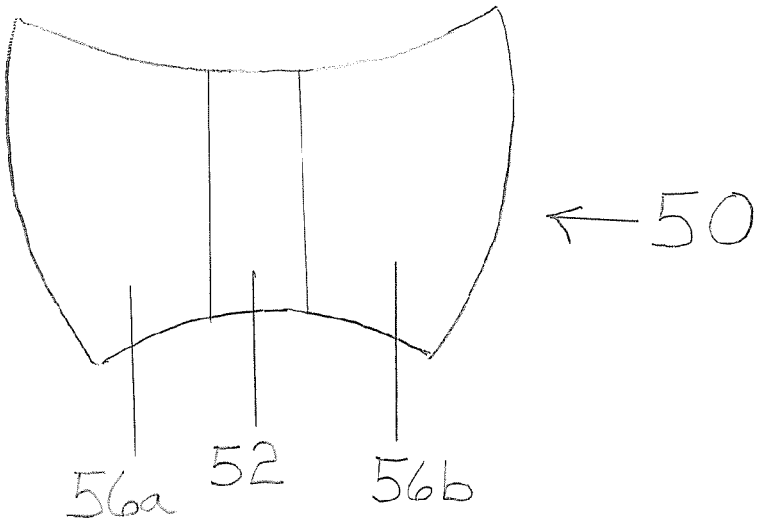
FIG. 36 is a plan view of a platform shoe upper having a center region comprising flexible material in accordance with embodiments of the present invention.

With reference to FIG. 36 a flexible upper 50 in accordance with embodiments of the present invention is shown. Flexible upper 50 contains a center region 52 made from a stretchable material such as elastic fiber. The center region 52 is surrounded by two regions 56*a* and 56*b* that are made from substantially non-stretchable material, such as leather. It is noted here that terms "stretchable" and non-stretchable as used herein are relative to each other. The center region 52 allows the upper 50 to stretch, allowing it to attach to different lower shoe members 14 that may contain different placements of the snaps 22.

Figure 37:
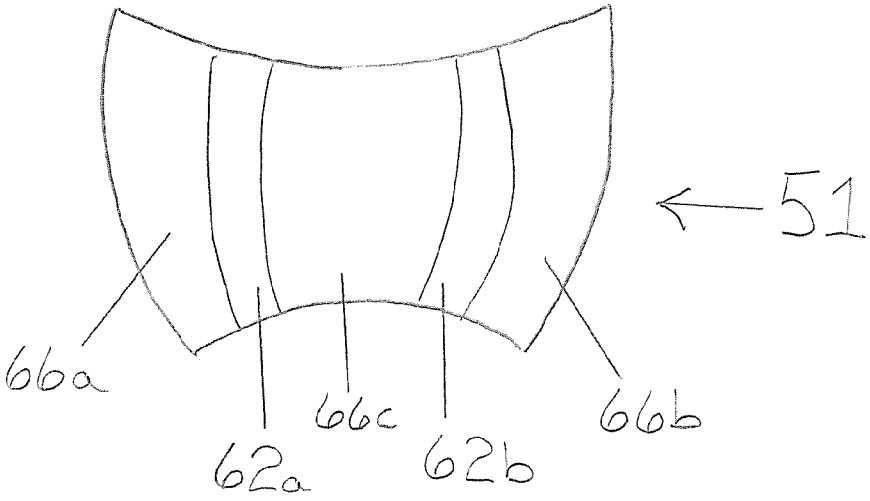
FIG. 37 is a plan view of a platform shoe upper having two substantially parallel regions of flexible material in accordance with embodiments of the present invention.

With reference to FIG. 37, an additional flexible upper 51 in accordance with embodiments of the present invention is shown. Flexible upper 51 contains two substantially parallel regions 62*a* and 62*b* of stretchable material. Two substantially non-stretchable regions 66 are located laterally adjacent to each stretchable region 62*a* and 62*b*. Additionally, a substantially non-stretchable region 66*c* is located between the stretchable regions 62*a* and 62*b*. The stretchable regions 62*a* and 62*b* allows the flexible upper 51 to stretch, allowing it to attach to different lower shoe members 14 that may contain different placements of the snaps 22. Alternative orientations of stretchable and non-stretchable regions combined to form a flexible upper are considered within the scope of the invention.

The method of making a snap shoe 10 in accordance with embodiments of the present invention differs from the method of making a standard shoe. The first step in making a standard shoe is to sew or otherwise form the upper portion around the last. Next, the upper portion is sewn or stitched to the insole underneath the last. Finally, shoe components such as a shank, additional fiberboard, a platform or an outsole are attached to the shoe. A snap shoe 10 in accordance with embodiments of the present invention is constructed in a different way.

Figure 38:
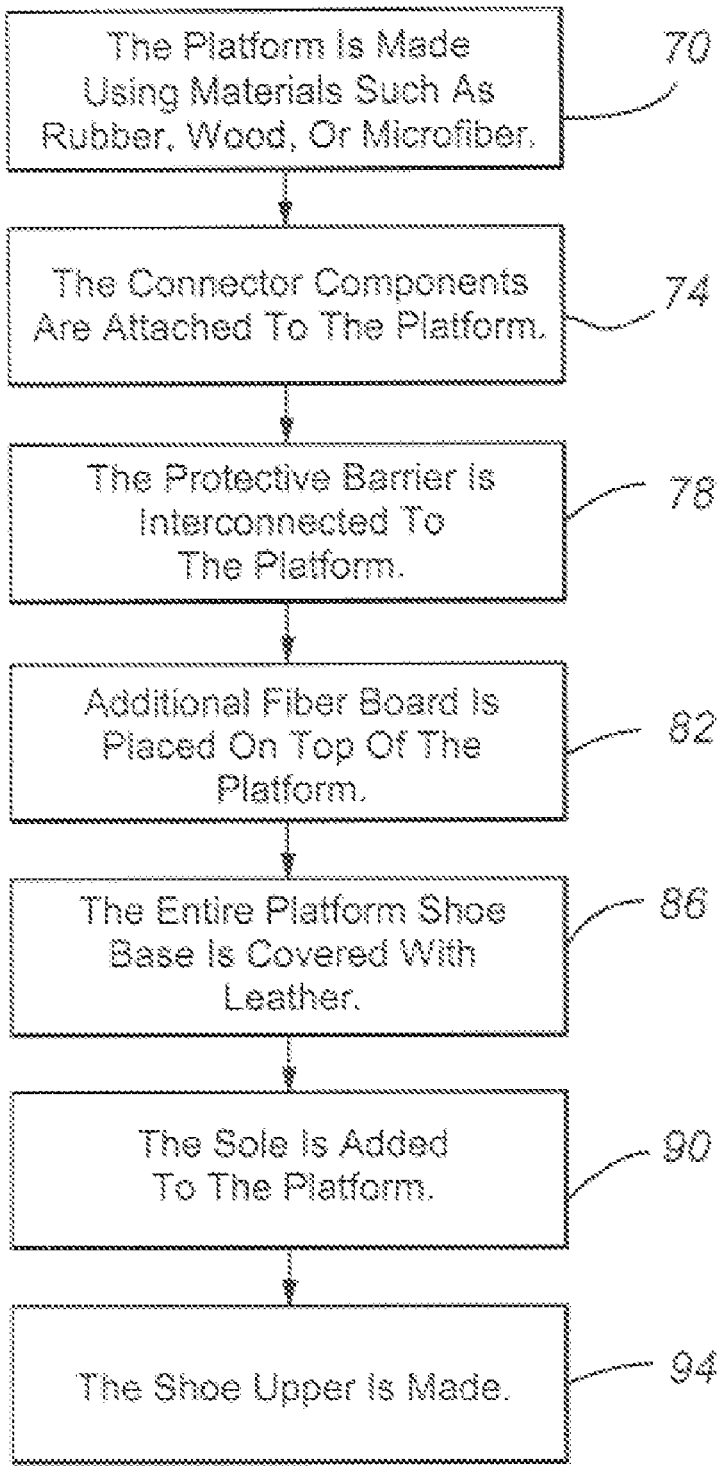
FIG. 38 is a flow diagram of a method of making a shoe in accordance with embodiments of the present invention.

FIG. 38 shows a flow chart illustrating the steps used to make a snap shoe 10. At step 70 a platform is made. Various materials can be used to make the platform including rubber, microfiber, or wood. At step 74, connector components, such as snaps, are interconnected to the platform. The connector components are placed on the platform surface in a way that will create a smooth edge so as not to compromise the integrity or cut into other materials that with be added later. For example, an edge of the connector component can be oriented flush with the edge of the platform. Additionally, edges of the attachment components can be burnished, sanded, or otherwise dulled. Alternatively, the attachment components may be shaped to curve into the platform. At step 78, a protective barrier is interconnected to the platform in order to protect an outer covering material that will be added later from being damaged by sharp edges of the connector components. The protective barrier may be left out, if it is found that the dulling the edges of the connector components will provide sufficient protection for the outer covering material. At step 82, addition fiberboard may be placed on top of the platform and beneath the surface of the last. At step 86, the entire base is covered with a covering material such as leather. If the platform base includes a heal shape, this portion is also covered. If the platform base does not include a heal shape, a finished heal, covered with leather, can be attached later. At step 90, the sole, or outermost portion of the bottom of the shoe, is added using adhesive, nails or other means of attachment. At step 94, the upper shoe member including attached snap components is sewn or otherwise produced. Alternatively, the upper shoe member may be made before or in parallel to the lower shoe member being made.

As can be easily understood from the foregoing, the basic concepts of the present invention may be embodied in a variety of ways. It involves both adaptable footwear techniques as well as devices to accomplish the appropriate adaptable footwear. In this application, the adaptable footwear techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

With regard to the present disclosure, the reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "snap" should be understood to encompass disclosure of the act of "snapping"—whether explicitly discussed or not—and, conversely, were there effectively disclosure of the act of "snapping", such a disclosure should be understood to encompass disclosure of a "snap" and even a "means for snapping." Such changes and alternative terms are to be understood to be explicitly included in the description.

The following U.S. patents are incorporated by reference in their entirety: U.S. Pat. Nos. 5,992,058, 4,461,102, 4,300,294, and 3,952,429.

To assist in the understanding of the present invention the following list of components and associated numbering found in the drawings is provided herein:

10 Platform Shoe with Detachable Upper
14 Lower Shoe Member
18 Upper Shoe Member
22 Snaps
22*a* Male Snap Component
22*b* Female Snap Component

26 Platform Base
32 Platform
36 Leather
38 Holes in Leather
44 Burnished Edge
48 Barrier
49 Hole in Barrier
50 Flexible Upper
51 Flexible Upper
52 Center Region Stretchable Material
56*a*,56*b* Lateral Regions of Substantially Non-Stretchable Material
62*a*, 62*b* Substantially Parallel Regions of Stretchable Material
66*a*, 66*b* Lateral Regions of Substantially Non-Stretchable Material
66*c* Center Region of Substantially Non-Stretchable Material The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description of the Invention for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description of the Invention, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A shoe system, comprising:

a lower shoe member comprising a platform having a thickness;

a plurality of snaps having male and female components, said male components having a diameter not greater than said thickness of said platform and operably interconnected to said platform, said male components comprising a burnished circumferential edge;

a barrier interconnected to said platform and covering at least a portion of said circumferential edge of said male components, said barrier comprising a plurality of holes, wherein a portion of said male component extends through said hole laterally beyond said barrier;

a leather outer portion covering:

said platform;

at least a portion of said male components of said plurality of snaps; and said barrier;

said leather outer portion comprising a plurality of holes substantially aligned with said plurality of holes in said barrier, wherein a portion of said male component extends through said hole laterally beyond said leather outer portion;

an upper shoe member comprising at least one of said female components of said plurality of snaps, wherein said male and female snap components cooperate to provide a detachable attachment between said lower shoe member and said upper shoe member, said upper shoe member comprising a plurality of regions, wherein at least one region of said plurality of regions comprises stretchable material, and wherein at least one region of said plurality of regions comprises a substantially non-stretchable material.

2. The shoe system of claim 1, further comprising:

a second lower shoe member comprising:

a second platform having a second thickness;

a second plurality of male snap components having a diameter not greater than said second thickness of said second platform, wherein said second plurality of male snap components are interconnected to said second platform, said second plurality of male snap components comprising burnished circumferential edges;

a second barrier interconnected to said second platform and covering at least a portion of said circumferential edge of said second male snap components, said second barrier comprising a plurality of holes, wherein a portion of said male component extends though said hole laterally beyond said second barrier; and a second leather outer portion covering:

said second platform;

at least a portion of said male components of said second plurality of snaps; and said second barrier;

said second leather outer portion comprising a plurality of holes substantially aligned with said plurality of holes in said second barrier, wherein a portion of said second male snap components extend though said hole laterally beyond said second leather outer portion;

wherein said first plurality of male snap components interconnected to said first lower shoe member are spaced differently than said second plurality male snap components interconnected to said second lower shoe member; and wherein said upper shoe member is connectable to both said first and said second lower shoe members.

3. A shoe system, comprising:

a first shoe member comprising a platform and a covering material overlying at least a portion of said platform, wherein a plurality of first connector members are interconnected to said platform, and wherein a protective layer is located between at least a portion of said connection member and said covering material; and a second shoe member comprising a plurality of second connector members, wherein said first and second connector members cooperate to provide a detachable attachment between said first shoe member and said second shoe member.

4. The shoe system of claim 3, wherein said plurality of first connector members comprise male snap components, and wherein said second connector members comprise female snap components.

5. The shoe system of claim 3, wherein said covering material comprises leather.

6. The shoe system of claim 3, wherein said first connector members comprise burnished edges.

7. The shoe system of claim 3, wherein said second shoe member further comprises a plurality of regions, and wherein at least one region of said plurality of regions comprises stretchable material, and wherein at least one region of said plurality of regions comprises a substantially non-stretchable material.

8. The shoe system of claim 7, further comprising:

a third shoe member comprising a platform and a plurality of first connector members interconnected to said platform;

wherein said plurality of first connector members interconnected to said first shoe member platform are spaced differently than said plurality of first connector members interconnected to said third shoe member platform;

wherein said second shoe member is connectable to both said first and said third shoe members.

9. A shoe system, comprising:

a first shoe member comprising a platform and a covering material overlying at least a portion of said platform, wherein a plurality of first connector members are interconnected to said platform, and wherein said first connector members comprise burnished edges;

a second shoe member comprising a plurality of second connector members, wherein said first and second connector members cooperate to provide a detachable attachment between said first shoe member and said second shoe member; and wherein said first shoe member further comprises a protective layer located between at least a portion of said connection member and said covering material.

10. The shoe system of claim 9, wherein said first plurality of connector members comprise male snap components, and wherein said second connector members comprise female snap components.

11. The shoe system of claim 9, wherein said covering material comprises leather.

12. The shoe system of claim 9, wherein said second shoe member further comprises a plurality of regions, wherein at least one region of said plurality of regions comprises stretchable material, and wherein at least one region of said plurality of regions comprises a substantially non-stretchable material.

13. The shoe system of claim 12, further comprising:

a third shoe member comprising a platform and a plurality of first connector members interconnected to said platform;

wherein said plurality of first connector members interconnected to said first shoe member platform are spaced differently than said plurality of first connector members interconnected to said third shoe member platform;

wherein said second shoe member is connectable to both said first and said third shoe members.

14. A shoe system, comprising:

a first shoe member comprising a platform and a plurality of first connector members interconnected to said platform; and a second shoe member comprising a plurality of second connector members, wherein said first and second connector members cooperate to provide a detachable attachment between said first shoe member and said second shoe member, said second shoe member comprising a plurality of regions, and wherein at least one region of said plurality of regions comprises stretchable material, and wherein at least one region of said plurality of regions comprises a substantially non-stretchable material;

wherein said first shoe member further comprises a covering material overlying at least a portion of said platform; and wherein said first shoe member further comprises a protective layer located between at least a portion of said connection member and said covering material.

15. The shoe system of claim 14, wherein said first plurality of connector members comprise male snap components, and wherein said second connector members comprise female snap components.

16. The shoe system of claim 14, further comprising:

a third shoe member comprising a platform and a plurality of first connector members are interconnected to said platform;

wherein said plurality of first connector members interconnected to said first shoe member platform are spaced differently than said plurality of first connector members interconnected to said third shoe member platform;

wherein said second shoe member is connectable to both said first and third shoe members.

17. The shoe system of claim 14, wherein said covering material comprises leather.

18. The shoe system of claim 14, wherein said first connector members comprise burnished edges.

19. A method of making a shoe, comprising the steps of:

(a) forming a lower shoe member by the steps of:

(i) forming a shoe platform;

(ii) interconnecting a plurality of first connector members to said shoe platform;

(iii) interconnecting a barrier member to said shoe platform, wherein said barrier member covers at least a circumferential portion of said connector members; and (iv) covering said platform, said barrier member and at least a portion of said first connector member with a material; and (b) forming an upper shoe member comprising a second plurality of connector members;

wherein said first and second connector members cooperate to provide a detachable attachment between said first shoe member and said second shoe member.

* * * * *